US007666563B2

(12) United States Patent
Ohki et al.

(10) Patent No.: US 7,666,563 B2
(45) Date of Patent: Feb. 23, 2010

(54) TONER AND DEVELOPER USING THE TONER

(75) Inventors: Masahiro Ohki, Iruma (JP); Naohiro Watanabe, Shizuoka (JP); Ryota Inoue, Mishima (JP); Masahide Yamada, Numazu (JP); Akinori Saitoh, Numazu (JP); Shigeru Emoto, Numazu (JP); Tsunemi Sugiyama, Kashiwa (JP); Shinichi Wakamatsu, Numazu (JP)

(73) Assignee: Ricoh Company Limited, Tokyo (JP)

( * ) Notice: Subject to any disclaimer, the term of this patent is extended or adjusted under 35 U.S.C. 154(b) by 525 days.

(21) Appl. No.: 11/513,175

(22) Filed: Aug. 31, 2006

(65) Prior Publication Data

US 2007/0054210 A1 Mar. 8, 2007

(30) Foreign Application Priority Data

Sep. 5, 2005 (JP) ..... 2005-255834
Jan. 11, 2006 (JP) ..... 2006-003146

(51) Int. Cl.
*G03G 9/09* (2006.01)

(52) U.S. Cl. ..... 430/108.21; 430/109.4

(58) Field of Classification Search ..... 430/108.21, 430/109.4

See application file for complete search history.

(56) References Cited

U.S. PATENT DOCUMENTS 5,747,210 A 5/1998 Emoto et al.
5,865,381 A * 2/1999 Mitsumura et al. ..... 241/18
5,998,080 A * 12/1999 Ohno et al. ..... 430/45.54
6,106,986 A * 8/2000 Shirai et al. ..... 430/109.4
6,221,549 B1 4/2001 Emoto et al.
6,335,137 B1 1/2002 Suzuki et al.
6,395,443 B2 5/2002 Kuroda et al.
6,468,706 B2 10/2002 Matsuda et al.
6,534,232 B1 3/2003 Matsuda et al.
6,544,704 B1 4/2003 Matsuda et al.
6,660,443 B2 12/2003 Sugiyama et al.
6,682,866 B2 1/2004 Sugiyama et al.
6,740,460 B2 5/2004 Tomita et al.
6,756,175 B2 6/2004 Yamada et al.
6,787,280 B2 9/2004 Yamashita et al.
6,800,412 B2 10/2004 Sugiyama et al.
6,824,945 B2 11/2004 Emoto et al.
6,835,519 B2 12/2004 Sugiyama et al.
6,846,604 B2 1/2005 Emoto et al.
6,849,369 B2 2/2005 Yagi et al.
6,852,462 B2 2/2005 Emoto et al.
6,936,390 B2 8/2005 Nanya et al.
6,946,229 B2 9/2005 Suzuki et al.
6,947,692 B2 9/2005 Kondo et al.
7,005,223 B2 2/2006 Yamashita et al.
7,056,635 B2 6/2006 Tanaka et al.
7,056,636 B2 6/2006 Tomita et al.
7,056,638 B1 6/2006 Tomita et al.
7,074,535 B2 7/2006 Saito et al.
7,074,541 B2 7/2006 Yamashita et al.
7,083,890 B2 8/2006 Emoto et al.
2003/0027066 A1 2/2003 Yamashita et al.
2003/0055159 A1 3/2003 Yamashita et al.
2003/0096185 A1 5/2003 Yamashita et al.
2004/0053154 A1 3/2004 Tomita et al.
2004/0115551 A1 6/2004 Sugiyama et al.
2004/0131961 A1 7/2004 Watanabe et al.
2004/0157146 A1 8/2004 Tomita et al.
2004/0175641 A1 9/2004 Nanya et al.
2004/0209181 A1 10/2004 Higuchi et al.
2004/0229147 A1 11/2004 Higuchi et al.
2004/0259013 A1 12/2004 Ohtani et al.
2004/0265721 A1 12/2004 Matsuoka et al.
2005/0003288 A1 1/2005 Sugiyama et al.
2005/0003291 A1 1/2005 Takada et al.
2005/0008961 A1 1/2005 Takada et al.
2005/0026066 A1 2/2005 Tanaka et al.
2005/0031980 A1 2/2005 Inoue et al.
2005/0042534 A1 2/2005 Tanaka et al.
2005/0079433 A1 4/2005 Watanabe et al.
2005/0112488 A1 5/2005 Yamada et al.
2005/0164112 A1 7/2005 Ohki et al.
2005/0164114 A1 7/2005 Yagi et al.
2005/0180786 A1 8/2005 Yamada et al.

(Continued)

FOREIGN PATENT DOCUMENTS

JP 10-142835 5/1988
JP 63-186253 8/1988
JP 07-188575 7/1995
JP 09-179331 7/1997
JP 11052623 A * 2/1999
JP 11-327197 11/1999
JP 2000-098661 4/2000
JP 2000-214638 8/2000
JP 2001-051444 2/2001
JP 2001-066824 3/2001
JP 2001-066825 3/2001

(Continued)

OTHER PUBLICATIONS

Partial English language translation of JP 11-052623 (Feb. 1999).*
Diamond, Arthur S & David Weiss (eds.) Handbook of Imaging Materials, 2nd ed.. New York: Marcel-Dekker, Inc. (Nov. 2001) pp. 182, 183, 187-189.*
U.S. Appl. No. 12/040,451, filed Feb. 29, 2008 Saitoh, et al.

(Continued)

*Primary Examiner*—Christopher RoDee
(74) *Attorney, Agent, or Firm*—Oblon, Spivak, McClelland, Maier & Neustadt, L.L.P.

(57) ABSTRACT

A toner is provided including a binder resin including at least one polyester resin in an amount of from 50 to 100% by weight, and a colorant having a specific formula, wherein the toner has a shape factor SF-1 of from 120 to 150 and a shape factor SF-2 of from 125 to 180; and a developer using the toner.

18 Claims, 3 Drawing Sheets

U.S. PATENT DOCUMENTS

| | | | |
|---|---|---|---|
| 2005/0186498 | A1 | 8/2005 | Honda et al. |
| 2005/0196691 | A1 | 9/2005 | Ohtani et al. |
| 2005/0250036 | A1 | 11/2005 | Emoto et al. |
| 2005/0277044 | A1 | 12/2005 | Watanabe et al. |
| 2005/0277045 | A1 | 12/2005 | Saito et al. |
| 2006/0046174 | A1 | 3/2006 | Ohki et al. |
| 2006/0056888 | A1 | 3/2006 | Sugiyama et al. |
| 2006/0057488 | A1 | 3/2006 | Inoue et al. |
| 2006/0063089 | A1 | 3/2006 | Tanaka et al. |
| 2006/0068312 | A1 | 3/2006 | Yamashita et al. |
| 2006/0099529 | A1 | 5/2006 | Tanaka et al. |
| 2006/0127788 | A1 | 6/2006 | Yamashita et al. |

FOREIGN PATENT DOCUMENTS

| | | |
|---|---|---|
| JP | 2001-147555 | 5/2001 |
| JP | 2003-084499 | 3/2003 |
| JP | 2004-246344 | 9/2004 |
| JP | 2005-003751 | 1/2005 |
| JP | 2005-049853 | 2/2005 |

OTHER PUBLICATIONS

U.S. Appl. No. 11/734,895, filed Apr. 13, 2006 Yamashita et al.
U.S. Appl. No. 11/206,128, filed Aug. 18, 2005, Yamashita, et al.
U.S. Appl. No. 11/868,618, filed Oct. 8, 2007, Sugiyama, et al.
U.S. Appl. No. 12/203,278, filed Sep. 3, 2008, Yamada, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.

* cited by examiner

TONER AND DEVELOPER USING THE TONER

BACKGROUND OF THE INVENTION

1. Field of the Invention

The present invention relates to a toner and a developer using the toner for use in electrophotography.

2. Discussion of the Background

In an electrophotographic apparatus or an electrostatic recording apparatus, an electric latent image or a magnetic latent image is visualized with a toner. For example, in electrophotography, an electrostatic latent image formed on a photoreceptor is developed with a toner to form a toner image. The toner image is typically transferred onto a transfer material, and then fixed upon application of heat thereto. Typically, a toner for use in an electrostatic latent image development is a colored particulate material in which a colorant, a charge controlling agent, and other additives are dispersed in a binder resin. Toner manufacturing methods are broadly classified into pulverization methods and polymerization methods.

In a pulverization method, a colorant, a charge controlling agent, an offset-inhibitor, etc. are mixed and melt-kneaded with a thermoplastic resin, and then the mixture is pulverized and classified to prepare toner particles. Pulverized toners typically have properties on a reasonable level, however, materials that can be used for the pulverized toners are limited. For example, the melt-kneaded mixture has to be pulverized and classified using an economically usable apparatus. Therefore, the melt-kneaded mixture has to be brittle. In this case, particles having various particle diameters tend to be produced, i.e., the resultant toner has a broad particle diameter distribution. In order to produce high definition and high gradation images, for example, fine particles having a particle diameter of not greater than 5 μm and coarse particles having a particle diameter of not less than 20 μm have to be removed, resulting in deterioration of the toner yield. In addition, it is difficult to uniformly disperse toner components (such as a colorant and a charge controlling agent) in a thermoplastic resin in the melt-kneading process. Further, the colorant tends to present at the surface of the toner, and therefore charge quantity distribution of the toner broadens, resulting in deterioration of developability. Pulverization toners have insufficient toner properties to be used for high-performance image forming apparatuses.

In attempting to solve the above-mentioned problems of the pulverization method, suspension polymerization methods have been proposed. It is known that spherical toner particles are obtained by a suspension polymerization method. However, spherical toners have poor cleanability. When an image having low image proportion is formed on an image bearing member and then transferred, toner particles hardly remain on the image bearing member. In contrast, when an image having high image proportion is formed on an image bearing member and then transferred, toner particles tend to remain on the image bearing member and thereby the produced images have background fouling. Such residual toner particles also contaminate a charging roller configured to charge a photoreceptor, resulting in deterioration of charging ability thereof.

The suspension polymerization method has another drawback so as to have low flexibility in choosing raw materials for use therein. Since the binder resin is limited to resins which can be formed by polymerization reaction at a time of forming toner particles, almost all the resins which are conventionally used for toners cannot be used for the suspension polymerization method. In addition, particle diameter distribution of the toner cannot be well controlled due to the existence of internal additives (such as colorants) in some cases. In particular, the largest problem is that polyester resins, which can impart good fixability and color reproducibility to the resultant toner, cannot be used for the suspension polymerization method.

In attempting to solve these problems, Japanese Patent No. 2537503 discloses a toner manufacturing method in which fine resin particles obtained by an emulsion polymerization are associated to form toner particles having irregular shapes. (This method is hereinafter referred to as emulsion aggregation method, and the resultant toner is hereinafter referred to as emulsion aggregation toner.) However, a large amount of surfactant remains both on the surface of the toner particles and inside of the toner particles even after the toner particles are subjected to a washing process. As a result, the resultant toner has poor environmental stability in chargeability and broad particle diameter distribution, and thereby background fouling tends to occur in produced images. In addition, the residual surfactant contaminates image forming members (such as photoreceptor, charging roller, and developing roller). Although colorant particles hardly present at the surface of the resultant toner, the colorant particles are easily aggregated in the toner. In other words, it is difficult to uniformly disperse colorant particles in the emulsion aggregation toner. As a result, the resultant toner has an uneven chargeability, resulting in deterioration of charging stability after long repeated use. If developability and transferability of color toners slightly deteriorate, color balance and gradation of the resultant color images also deteriorate. When colorant particles are aggregated, light is diffusely reflected at the surface of the aggregated colorant particles, resulting in deterioration of transparency of toner images. When such toner images are formed on overhead projection (OHP) sheet, the projected images have poor color reproducibility.

Full-color image forming apparatuses typically use toners including a release agent without using an oil supplying device which applies an oil to the fixers. However, it is difficult to prepare a release agent having as small a particle diameter as colorants, and it is more difficult to uniformly disperse such a small release agent in the toner. When the release agent is not uniformly dispersed, chargeability, developability, and preservability of the toner, and transparency of toner images deteriorate.

Conventional yellow toners typically include dichlorobenzidine pigments (such as C. I. Pigment Yellow 17) as colorants. However, since the use of dichlorobenzidine is restricted in Germany and a product including dichlorobenzidine cannot obtain Blue Angel Mark, which is an ecology mark in Germany, a need exist for toners including no dichlorobenzidine pigment. Specific examples of yellow colorants including no dichlorobenzidine include C. I. Pigment Yellow 155, C. I. Pigment Yellow 180, C. I. Pigment Yellow 93, C. I. Pigment Yellow 74, etc. Some of these pigments show too high a structural viscosity when the pigment is dispersed in a solvent. In this case, it is difficult to obtain toner particles by the above-mentioned polymerization methods. On the other hand, some of these pigments have compatibility with water. In this case, the pigments cannot be held in toner particles and move into the water.

Polymerization methods except the emulsion aggregation methods typically produce spherical toner particles. Since spherical toner particles have small adhesion to a photoreceptor and easily release therefrom, the spherical toner particles can be sufficiently transferred. Moreover, adhesion among the spherical toner particles is small, and therefore each of the spherical toner particles is easily influenced by electric force.

Therefore the toner particles adhere a latent image along the electric flux line, and thereby a toner image faithful to the latent image can be produced. However, such spherical toner particles tend to roll on a transfer paper when the toner particles contact a fixing member, resulting in producing abnormal images. In addition, since the spherical toner particles tend to roll on a photoreceptor, it is difficult to remove the spherical toner particles remaining on the photoreceptor using a cleaning blade.

Published unexamined Japanese Patent Applications Nos. (hereinafter referred to as JP-A) 09-179331, 10-142835, and 11-327197 have disclosed toners having specific shape factors SF-1 and/or SF-2. It is described therein that by controlling the shape factors, a good combination of toner properties such as chargeability, developability, transferability, and cleanability can be imparted to the resultant toner.

JP-A 2001-51444 discloses a toner having a specific shape factor and a specific surface are a ratio defined by the following equation: $R=\rho\times D_{50p}\times S$, wherein R represents a surface area ratio, $\rho$ ($g/m^3$) represents the specific gravity of the toner, $D_{50p}$ (m) represents the number average particle diameter of the toner, and S ($g/m^2$) represents the BET specific surface area of the toner. The surface area ratio R represents irregularity (i.e., degree of concavity and convexity) of the surface of the toner, which is an evaluation measure different from the above shape factors. It is described in JP-A 2001-51444 that a toner having too large a surface area ratio R has too large irregularity and such a toner causes a problem in that external additives are embedded in concavities and therefore the toner cannot maintain good chargeability and transfer ability for along period of time.

Because of these reasons, a need exists for a yellow toner which can be used for high-performance image forming apparatuses.

SUMMARY OF THE INVENTION

Accordingly, an object of the present invention is to provide an environment-friendly yellow toner and a developer using the toner having good coloring power, thermal resistance, cleanability, chargeability, and fixability.

These and other objects of the present invention, either individually or in combinations thereof, as hereinafter will become more readily apparent can be attained by a toner, comprising:

a binder resin, comprising at least one polyester resin in an amount of from 50 to 100% by weight; and a colorant, having the formula (I):

(I)

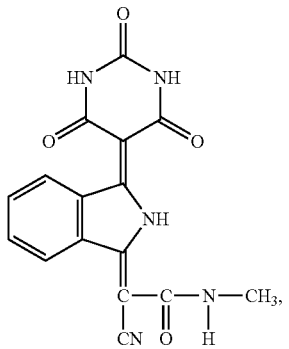

wherein the toner has a shape factor SF-1 of from 120 to 150 and a shape factor SF-2 of from 125 to 180;

and a developer using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Generally, the present invention provides a toner comprising a compound having the following formula (I) as a yellow colorant:

(I)

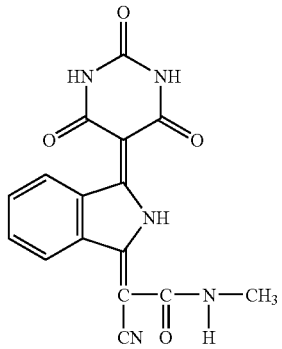

A combination of the compound having the formula (I) and after-mentioned polyester resin provides a toner having a desired shape. Since the compound having the formula (I) includes no chlorine atom, the compound having the formula (I) is not restricted to be used in Germany and can obtain Blue Angel Mark, which is an ecology mark in Germany. The compound having the formula (I) has high coloring power and good thermal resistance. Specific examples of the compound having the formula (I) include C. I. Pigment Yellow 185, etc. Specific examples of the marketed products of the compound having the formula (I) include PALIOTOL® YELLOW D1155 (from BASF Aktiengesellschaft), etc. The resultant toner preferably includes the compound having the formula (I) in an amount of from 1 to 25 parts by weight, and more preferably from 2.5 to 11.0 parts by weight, based on 100 parts by weight of a binder resin.

The toner of the present invention has a shape factor SF-1 of from 120 to 150 and another shape factor SF-2 of from 125 to 180.

Figure 1:
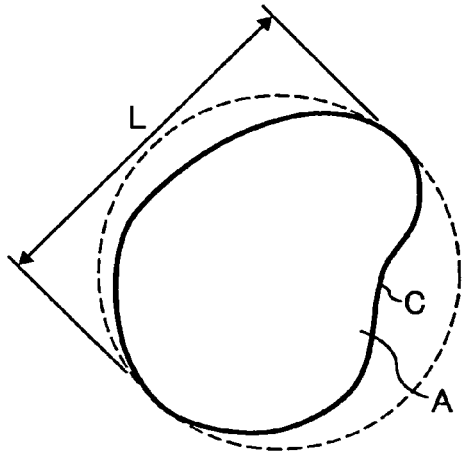
FIG. 1 is a schematic view for explaining how to determine the shape factors SF-1 and SF-2.

FIG. 1 is a schematic view for explaining how to determine the shape factors SF-1 and SF-2.

The shape factor SF-1 represents the degree of the roundness of a toner particle, and is defined by the following equation (1):

$$SF\text{-}1=(L^2/A)\times(100\pi/4) \quad (1)$$

wherein L represents a diameter of the circle circumscribing the projected image of a toner particle; and A represents the area of the projected image.

When the SF-1 is 100, the toner particle has a true spherical form. When the SF-1 is larger than 100, the toner particles have irregular forms.

The toner of the present invention has the shape factor SF-1 of from 120 to 150. When the SF-1 is larger than 150, the surface area of the toner increases. Typically, the content of the charge controlling agent is increased as the surface area of the toner increases, however in this case, the toner has too high a charge quantity per unit weight (μC/g) and broad charge quantity distribution. The proper charge quantity per unit weight of the toner is determined depending on the image forming process used. In addition, when the SF-1 is larger than 150, the toner particles cannot faithfully move along the electric field in the developing process and in the transfer process. As a result, high definition images cannot be produced. In contrast, when the SF-1 is less than 120 (i.e., the toner is nearly spherical), the toner has poor cleanability. Even if each of the toner particles of the present invention has the SF-1 value of from 120 to 150, cleanability of the toner deteriorates when the toner has broad SF-1 distribution. Therefore, the toner of the present invention preferably has the SF-1 value of from 135 to 150.

The shape factor SF-2 represents the degree of the concavity and convexity of a toner particle, and is defined by the following equation (2):

$$SF\text{-}2=(C^2/A)\times(100/4\pi) \quad (2)$$

wherein C represents the peripheral length of the projected image of a toner particle; and A represents the area of the projected image.

When the SF-2 approaches 100, the toner particles have a smooth surface (i.e., the toner has few concavity and convexity) When the SF-2 is large, the toner particles are roughened.

The toner of the present invention has the shape factor SF-2 of from 125 to 180. When the SF-2 is larger than 180, the toner has a large amount of concavity and convexity and therefore the surface of the toner particle cannot be uniformly charged, resulting in occurrence of background fouling in produced image. It is more preferable that the toner of the present invention has the SF-2 of from 125 to 140. When the SF-2 is less than 125, external additive particles tend to roll on the smooth surface of the toner, resulting in deterioration of chargeability and cleanability of the toner. When the SF-2 is larger than 140, the external additive particles are embedded in convexities, resulting in deterioration of fluidity and quickly-charging property, and producing abnormal images having background fouling.

Since typical external additives have higher hardness than binder resins, the external additive particles are easily embedded in the binder resin. In particular, in a toner having small SF-2 (i.e., a toner having few concavity and convexity), the external additive particles are embedded in the binder resin (not in the convexities). Therefore, such embedded external additive particles cannot contribute to impart chargeability to the toner.

The shape factors SF-1 and SF-2 are determined by the following method:

(1) particles of a toner are photographed using a scanning electron microscope (FE-SEM S-800 manufactured by Hitachi Ltd.) at a magnification of 500 times; and (2) photographic images of 100 randomly selected toner particles are analyzed using an image analyzer (LUZEX III manufactured by Nicolet Corp.) to determine the SF-1 and SF-2.

The binder resin of the toner of the present invention includes a polyester resin in an amount of from 50 to 100% by weight. In this case, the resultant toner has good fixability and color reproducibility, and therefore the toner can be used in high-speed machines and full-color machines. Any known polyester resins (such as modified polyester resins, non-modified polyester resins, and low-molecular-weight polyester resins) can be used for the binder resin. The binder resin of the toner preferably includes the polyester resin in an amount of from 50 to 100% by weight, and more preferably from 75 to 100% by weight.

The toner shape can be controlled by changing the condition of the surface of the colorant having the formula (I). In particular, when the colorant has a large amount of hydrophilic group on the surface thereof, the colorant tends to gather at the surface of the toner due to high polarity of water, resulting in formation of a lot of dimples on the surface of the toner. In contrast, when the colorant is surface-treated with a rosin resin, i.e., when the colorant has a large amount of hydrophobic group on the surface thereof, the colorant tends not to gather at the surface of the toner. Namely, by controlling hydrophilicity and hydrophobicity of the colorant, the toner shape can be controlled.

Specific preferred examples of suitable surface treatment agents for the colorant include natural rosins (e.g., gum rosin, wood rosin, tall rosin), derivatives of abietic acid (e.g., abietic acid, levopimaric acid, dextropimaric acid) and metal salts (e.g., calcium salt, sodium salt, potassium salt, magnesium salt) thereof, rosin-modified maleic acid resin, rosin-modified phenolic acid resin, etc., but are not limited thereto. In particular, acid surface treatment agents are preferably used because of having high affinity for colorant dispersing agents and high chargeability. The colorant is preferably surface-treated with 0.1 to 100% by weight of the surface treatment agent, and more preferably from 0.1 to 10% by weight thereof, based on the colorant.

In particular, the rosin-modified colorant is preferably used in the present invention. By controlling affinity between the colorant and the oil phase (i.e., toner constituent mixture liquid), and that between the colorant and the aqueous medium, the colorant can be dispersed inside the toner as appropriate. When the rosin-modified colorant is used, a binder resin can be flexibly chosen. In addition, dispersibility of the rosin-modified colorant does not deteriorate by addition of another internal additives such as waxes. The toner including the rosin-modified colorants has good combination of chargeability, fluidity, stability, transferability, and cleanability. A developer including the toner can produce high quality images and highly transparent images.

The colorant can be rosin-modified by any known methods, and not particularly limited. For example, the following method is known:

(1) dissolving a rosin in a solvent and dispersing a colorant therein so that the colorant adsorb the rosin;

(2) filtering the mixture and subjecting to drying.

Another example is disclosed in, for example, JP-A 07-188575.

Any known rosins can be used for the surface treatment agents of the colorant. Specific examples of the rosins include natural rosins including abietic acid, dextropimaric acid and the like as a main component (e.g., wood rosin, gum rosin) modified (e.g., hydrogenated, oxidized) rosins, derivatives of rosins (e.g., alkyd adducts of rosins, alkylene oxide adducts of rosins, rosin-modified phenol), etc., but are not limited thereto.

The colorant is preferably surface-treated with 0.1 to 10% by weight of the rosin, based on the colorant. The rosin-modified colorant shows more vivid color than unmodified colorant. In addition, the rosin-modified colorant has better dispersibility in the binder resin than unmodified colorant. The rosin-modified colorant imparts good coloring power to the resultant toner even if the amount thereof is small. When the amount of the treated rosin is too large, the modified colorant may have less affinity for the binder resin and the resultant toner may have uneven chargeability.

As mentioned above, the toner of the present invention has the following good properties.

(1) Since the toner includes the colorant having the formula (I), the toner is not restricted to be used in Germany and can obtain Blue Angel Mark, which is an ecology mark in Germany. The colorant also has high coloring power and good thermal resistance.

(2) Since the colorant is surface-treated, the toner shape can be easily controlled. Thereby, spherical toner which has poor cleanability is not obtained.

(3) Since the colorant is surface-treated, flexibility in choosing binder resin improves. In addition, dispersibility of the colorant does not deteriorate even if the other additives such as waxes are added therein.

The toner of the present invention is manufactured in an aqueous medium. Specific examples of the toner manufacturing methods in an aqueous medium include dissolution suspension method, etc. Among these, the following method is preferably used:

dissolving or dispersing at least a polymer capable of reacting with an active hydrogen (i.e., a precursor of a binder resin) and a colorant, in an organic solvent to prepare a toner constituent mixture liquid;

dispersing the toner constituent mixture liquid in an aqueous medium while subjecting the polymer to a reaction with a compound having an active hydrogen, to prepare a dispersion including toner particles; and removing the organic solvent from the dispersion, followed by washing and drying.

This method will be explained in detail.

Organic Solvent

Any known organic solvents which can dissolve and/or disperse toner constituents can be used in the present invention. Volatile solvents having a boiling point of less than 150° C. are preferably used because such solvents can be easily removed from the toner constituent mixture liquid. Specific examples of the solvents include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, and mixtures thereof, but are not limited thereto. The toner constituent mixture liquid typically includes a solvent in an amount of from 40 to 300 parts by weight, preferably from 60 to 140 parts by weight, and more preferably from 80 to 120 parts by weight, based on 100 parts by weight of the toner constituents.

Modified Polyester

The polymer capable of reacting with an active hydrogen has a functional group capable of reacting with an active hydrogen. Specific examples of such functional groups include isocyanate group, epoxy group, carboxyl acid group, acid chloride group, etc., but are not limited thereto. Among these, isocyanate group is preferably included in the polymer. Namely, the most suitable polymer for use in the toner of the present invention is a polyester (RMPE) modified by a functional group capable of forming a urea bond. Specific examples of the RMPE include polyester prepolymers (A) having an isocyanate group, but are not limited thereto. Specific examples of the polyester prepolymers (A) include compounds obtained by reacting (1) a base polyester formed by polycondensation reaction between a polyol (PO) and a polycarboxylic acid (PC), and having an active hydrogen, with (2) a polyisocyanate (PIC), but are not limited thereto. Specific examples of functional groups including the active hydrogen, of which the base polyester includes, include hydroxyl group (alcoholic hydroxyl group and phenolic hydroxyl group) amino group, carboxyl group, mercapto group, etc., but are not limited thereto. Among these, alcoholic hydroxyl group is preferably included in the base polyester.

In the present invention, a polymer capable of reacting with an active hydrogen forms a modified polyester. For example, a urea-modified polyester is formed by being subjected the RMPE to an elongation reaction with a compound having an active hydrogen.

For this reason, it is easy to control molecular weight of modified polyesters (MPE) such as the urea-modified polyester. In other words, it is easy to control fixability of the resultant toner. Since the urea-modified polyester includes the skeleton of the base (i.e., unmodified) polyester unit, the resultant toner maintains high fluidity and transparency originated from the properties of the base (i.e., unmodified) polyester.

As the polyol (PO), diols (DIO) and polyols (TO) having three or more valences can be used, and diols (DIO) alone or mixtures of a diol and a small amount of a polyol are preferably used.

Specific examples of diol (DIO) include, but are not limited to, alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polypropylene glycol and polytetramethylene ether glycol; alicyclic diols such as 1,4-cyclohexanedimethanol and hydrogenated bisphenol A; bisphenols such as bisphenol A, bisphenol F and bisphenol S; adducts of the above-mentioned alicyclic diol with an alkylene oxide such as ethylene oxide, propylene oxide and butylenes oxide; and adducts of the above mentioned bisphenol with an alkylene oxide such as ethylene oxide, propylene oxide and butylenes oxide. In particular, an alkylene glycol having 2 to 12 carbon atoms and adducts of bisphenol with an alkylene oxide are preferably used, and a mixture thereof is more preferably used.

Specific examples of the polyols (TO) having three or more valences include, but are not limited to, multivalent aliphatic alcohols having three or more valences such as glycerin, trimethylolethane, trimethylolpropane, pentaerythritol and sorbitol; phenols having three or more valences such as trisphenol PA, phenol novolac and cresol novolac; and adducts of the above-mentioned polyphenol having three or more valences with an alkylene oxide.

As the polycarboxylic acid (PC), dicarboxylic acids (DIC) and polycarboxylic acids (TC) having three or more valences can be used. Dicarboxylic acids (DIC) alone, or mixtures of a dicarboxylic acid and a small amount of a polycarboxylic acid are preferably used.

Specific examples of the dicarboxylic acids (DIC) include, but are not limited to, alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylenedicarboxylic acid having 4 to20 carbon atoms and an aromatic dicarboxylic acid having 8 to 20 carbon atoms are preferably used.

Specific examples of the polycarboxylic acid (TC) having three or more valences include, but are not limited to, aromatic polycarboxylic acids having 9 to 20 carbon atoms such as trimellitic acid and pyromellitic acid. The polycarboxylic acid (PC) can be formed from a reaction between one or more of the polyols (PO) and an anhydride or lower alkyl ester of one or more of the above-mentioned acids. Suitable lower alkyl esters include, but are not limited to, methyl esters, ethyl esters, and isopropyl esters.

A polyol (PO) and a polycarboxylic acid (PC) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (PIC) include, but are not limited to, aliphatic polyisocyanates such as tetramethylene diisocyanate, hexamethylene diisocyanate and 2,6-diisocyanatemethylcaproate; alicyclic polyisocyanates such as isophorone diisocyanate and cyclohexylmethane diisocyanate; aromatic diisocyanates such as tolylene diisocyanate and diphenylmethane diisocyanate; aromatic aliphatic diisocyanates such as $\alpha,\alpha,\alpha',\alpha'$-tetramethylxylylene diisocyanate; isocyanurates; the above-mentioned polyisocyanates blocked with phenol derivatives, oxime and caprolactam; and their combinations.

A polyisocyanate (PIC) is mixed with a polyester so that the equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When the ratio [NCO]/[OH] is too large, low temperature fixability of the resultant toner deteriorates. When the ratio [NCO]/[OH] is too small, the urea content in the resultant modified polyester decreases and the hot offset resistance of the resultant toner deteriorates.

The content of the constitutional unit obtained from a polyisocyanate in the polyester prepolymer (A) (having a polyisocyanate group at its ends) is from 0.5 to 40% by weight, preferably from 1 to 30% by weight and more preferably from 2 to 20% by weight. When the content is too small, the hot offset resistance of the resultant toner deteriorates, and in addition, the thermal resistance and low temperature fixability of the toner also deteriorate. In contrast, when the content is too large, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the urea-modified polyester decreases and the hot offset resistance of the resultant toner deteriorates.

As the compound having an active hydrogen, amines (B) are preferably used. A urea-modified polyester is formed by a reaction between the polyester prepolymer (A) and the amine (B) Specific examples of the amines (B) include diamines (B.1) polyamines (B2) having three or more amino groups, amino alcohols (B3), amino mercaptans (B4), amino acids (B5) and blocked amines (B6) in which the amino groups in the amines (B1) to (B5) are blocked.

Specific examples of the diamines (B1) include, but are not limited to, aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorone diamine; aliphatic diamines such as ethylene diamine, tetramethylene diamine and hexamethylene diamine; etc.

Specific examples of the polyamines (B2) having three or more amino groups include, but are not limited to, diethylene triamine, triethylene tetramine, etc.

Specific examples of the amino alcohols (B3) include, but are not limited to, ethanol amine, hydroxyethyl aniline, etc.

Specific examples of the amino mercaptan (B4) include, but are not limited to, aminoethyl mercaptan, aminopropyl mercaptan, etc.

Specific examples of the amino acids (B5) include, but are not limited to, amino propionic acid, amino caproic acid, etc.

Specific examples of the blocked amines (B6) include, but are not limited to, ketimine compounds which are prepared toy reacting one of the amines (B1) to (B5) with a ketone such as acetone, methyl ethyl ketone and methyl isobutyl ketone; oxazoline compounds, etc.

Among these amines (B), diamines (B1) and mixtures in which a diamine is mixed with a small amount of polyamine (B2) are preferably used.

The molecular weight of the resultant urea-modified polyester can optionally be controlled using a molecular weight control agent, if desired. Specific examples of the molecular weight control agent include, but are not limited to, monoamines such as diethyl amine, dibutyl amine, butyl amine and lauryl amine; and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1/1.5 to 1.5/1 and more preferably from 1/1.2 to 1.2/1. When the mixing ratio is too large or too small, the molecular weight of the urea-modified polyester decreases, resulting in deterioration of hot offset resistance of the resultant toner.

The weight average molecular weight of the urea-modified polyester resin is 10,000 or more, preferably from 20,000 to 1,000,000 and more preferably from 30,000 to 1,000,000. When the weight average molecular weight is too small, hot offset resistance of the resultant toner deteriorates. The number-average molecular weight of the urea-modified polyester resin is not particularly limited when after-mentioned unmodified polyester resin is used in combination. Namely, the weight average molecular weight of the urea-modified polyester has priority over the number-average molecular weight thereof. However, when the urea-modified polyester resin is used alone, the number average molecular weight is typically 20,000 or less, preferably from 1,000 to 10,000 and more preferably from 2,000 to 8,000. When the number average molecular weight is too large, low temperature fixability of the resultant toner deteriorates, and in addition, glossiness of full color images deteriorates. The urea-modified polyester preferably has an acid value of from 0 to 30 mgKOH/g.

Unmodified Polyester

It is more preferable the toner of the present invention includes an unmodified polyester (C) having an acid value of from 0 to 30 mgKOH/g in combination with the urea-modified polyester, because low temperature fixability and glossiness of full color images of the toner improve. Specific examples of the unmodified polyester (C) include polycondensation products of the above-mentioned suitable polyols (1) and polycarboxylic acids (2). The unmodified polyester (C) may include a polyester modified with a bond except urea bond (i. e. other modifications may be present other than the presence of urea bonding).

It is preferable that the unmodified polyester and the urea-modified polyester are partially soluble with each other to improve low temperature fixability and hot offset resistance of the resultant toner. Therefore, the unmodified polyester and the urea-modified polyester preferably have similar structures.

A weight ratio of the urea-modified polyester to the unmodified polyester is from 5/95 to 75/25, preferably from 10/90 to 25/75, more preferably from 12/88 to 25/75, and even more preferably from 12/88 to 22/78. When the weight ratio of the urea-modified polyester resin is too small, the resultant toner has poor hot offset resistance, thermostable preservability and low temperature fixability.

Molecular Weight

The molecular weight of the unmodified polyester (C) can be measured with a gel permeation chromatography system such as HLC-8220GPC (manufactured by Tosoh Corporation) by the following method:

(1) about 1 g of a sample (i.e., the unmodified polyester (C) is put in a conical flask, and then 10 to 20 g of THF (tetrahydrofuran) is added thereto to prepare a sample solution of THF having a concentration of from 5 to 10% by weight;

(2) columns are stabilized in a heat chamber at a temperature of 40° C., and THF flows therein at a flow rate of 1 ml/min; and (3) 20 μl of the sample solution of THF is injected to the columns.

A molecular weight is calculated from a calibration curve (i.e., a relationship between molecular weight and retention time) prepared using standard monodisperse polystyrenes. For example, TSK STANDARD POLYETHYLENEs (manufactured by Tosoh Corporation) having a molecular weight of from $2.7\times10^2$ to $6.2\times10^6$ can be used as the standard monodisperse polystyrenes. As a detector, a refractive index detector (RI) is used. Specific examples of the columns include TSK-GEL®G1000H, G2000H, G2500H, G3000H, G4000H, G5000H, G6000H, and G7000H (manufactured by Tosoh Corporation), etc. These columns are used in combination.

The unmodified polyester (C) typically has a main peak molecular weight of from 1,000 to 30,000, preferably from 1,500 to 10,000, and more preferably from 2,000 to 8,000. When the unmodified polyester (C) includes too large an amount of components having a molecular weight of less than 1,000, thermostable preservability of the resultant toner deteriorates and the toner tends to contaminate the carrier. Therefore, the unmodified polyester (C) preferably includes the components having a molecular weight of less than 1,000in an amount of not greater than 5.0% by weight. When the unmodified polyester (C) includes too large an amount of components having a molecular weight of not less than 30,000, low temperature fixability of the resultant toner tends to deteriorate. However, it is possible to prevent the deterioration to the minimum by controlling the overall molecular weight distribution. The unmodified polyester (C) typically includes the components having a molecular weight of not less than 30,000 in an amount of not less than 1% by weight, and preferably from 3 to 6% by weight. When the amount is too small, the resultant toner has poor hot offset resistance. When the amount is too large, glossiness and transparency of the produced images deteriorate.

The unmodified polyester (C) preferably has a number average molecular weight (Mn) of from 2,000 to 15,000, and a ratio (Mw/Mn) between a weight average molecular weight (Mw) and the number average molecular weight (Mn) of not greater than 5. When the ratio is too large, the resultant toner has poor sharply-melting property and therefore the produced images have low glossiness.

THF Insoluble Components

When the unmodified polyester (C) includes THF insoluble components in an amount of from 1 to 15% by weight, hot offset resistance of the resultant toner improves. The amount of the THF insoluble components can be determined by the following method:

(1) about 1.0 g of a sample (A) (i.e., a resin or a toner) is added to about 50 g of THF and left for 24 hours at 20° C. to prepare a sample liquid;

(2) the sample liquid is subjected to centrifugal separation, followed by filtration using 5 kinds of filter papers described in JIS P3801;

(3) the filtrate is subjected to vacuum drying to remove the solvent (i.e., THF) therefrom and isolate a residual resin component (B); and (4) the amount of the residual resin (B) is measured.

The residual resin (B) is THF soluble components of the sample. When the sample is a resin, the ratio (Rr) of the THF insoluble components is calculated by the following equation:

$$Rr(\%)=((A-B)/A)\times100$$

wherein A represents the amount of the sample, and B represents the amount of the THF soluble components of the sample.

When the sample is a toner, the ratio (Rt) of the THF insoluble components is calculated by the following equation:

$$Rt(\%)=((A-B-W2)/(A-W1-W2))\times100$$

wherein A represents the amount of the sample, B represents the amount of the THF soluble components of the sample, W1 represents an amount of THF insoluble components of toner constituents other than the resin, and W2 represents an amount of THF soluble components of toner constituents other than the resin.

W1 and W2 can be measured by known methods (e.g., thermal reduction methods such as TG method).

Acid Value (AV) and Hydroxyl Value (OHV)

The unmodified polyester (C) preferably has a hydroxyl value of not less than 5 mgKOH/g, more preferably from 10 to 120 mgKOH/g, and more preferably from 20 to 80 mgKOH/g. When the hydroxyl value is too small, the resultant toner cannot have a good combination of thermostable preservability and low temperature fixability.

The unmodified polyester (C) preferably has an acid value of from 0 to 30 mgKOH/g, and more preferably from 5 to 25 mgKOH/g. When the unmodified polyester (C) has a proper acid value, the resultant toner can be easily negatively charged.

When the hydroxyl value and the acid value are beyond the above ranges, the resultant toner has poor environmental resistance, and therefore the produced image quality tends to deteriorate especially under conditions of high temperature and high humidity, and low temperature and low humidity.

The acid value (AV) and the hydroxyl value (OHV) are measured under the following conditions.

Measurement device: automatic potentiometric titrator DL-5 3 TITRATOR (manufactured by Mettler-Toledo International Inc.

Electrode: DG113-SC (manufactured by Mettler-Toledo International Inc.)

Analysis software: LabX Light Version 1.00.000

Device correction: using a mixed solvent of 120 ml of toluene and 30 ml of ethanol Measurement temperature: 23° C.

Measurement Conditions:

| | |
|---|---|
| Stir | |
| Speed [%] | 25 |
| Time [s] | 15 |
| EQP titration | |
| Titrant/Sensor | |
| Titrant | $CH_3ONa$ |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE (set) [mV] | 8.0 |
| dV (min) [mL] | 0.03 |
| dV (max) [mL] | 0.5 |
| Measure mode | Equilibrium controlled |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs | Yes |
| n = 1 | |
| comb. termination conditions | No |
| Evaluation | |
| Procedure | Standard |
| Potential 1 | No |
| Potential 2 | No |
| Stop for reevaluation | No |

The acid value (AV) is measured by a method based on JIS K0070-1992 as follows:

(1) 0.5 g of a sample or 0.3 g of ethyl acetate soluble component thereof is added to 120 ml of toluene, and the mixture is agitated for about 10 hours at room temperature (23° C.);

(2) 30 ml of ethanol is further added to the mixture to prepare a sample liquid; and (3) the sample liquid is titrated with a standardized N/10 potassium hydroxide alcohol solution, using the above-mentioned titrator.

An acid value is calculated from the following equation:

$$AV=KOH(\text{ml})\times N\times 56.1/Ws$$

wherein AV represents an acid value, KOH represents the amount of the standardized potassium hydroxide alcohol solution (ml) consumed in the titration, N represents the factor of the standardized caustic potash alcohol solution, and Ws represents the weight of the sample.

The hydroxyl value (OHV) is measured by a method based on JIS K0070-1966 as follows:

(1) 0.5 g of a sample is precisely weighed and fed to a 100 ml volumetric flask, and 5 ml of an acetylating agent is added thereto;

(2) the mixture is heated for 1 to 2 hours in a bath at a temperature of from 95 to 105° C.;

(3) the flask is took out of the bath and subjected to cooling;

(4) water is added to the flask, and then the flask is shaken so that acetic anhydride is decomposed;

(5) the flask is put into the bath again and heated for 10 minutes or more so that the acetic anhydride is completely decomposed;

(6) after subjected to cooling, the inner wall of the flask is washed out with an organic solvent to remove accretions;

(7) the organic solvent including the accretions is titrated with a standardized N/2 potassium hydroxide ethyl alcohol solution, using the above-mentioned titrator.

Glass Transition Temperature (Tg)

As mentioned above, the modified polyester of the present invention is obtained by elongation and/or crosslinking of the prepolymers in the toner manufacturing process. Since the resultant polymer has too high a molecular weight, the glass transition is not clearly observed in the polymer. Therefore, when the toner includes the unmodified polyester together with the modified polyester, the toner has the same glass transition temperature (Tg) as the unmodified polyester. Namely, Tg of the toner can be controlled by controlling Tg of the unmodified polyester. The toner of the present invention typically has a glass transition temperature of from 40 to 70° C., and preferably from 45 to 55° C. When the Tg is too small, thermostable preservability of the resultant toner deteriorates. When the Tg is too large, low temperature fixability of the resultant toner deteriorates. Since the toner of the present invention includes a polymer formed by elongation and/or crosslinking of the prepolymers, the toner has good thermostable preservability even if the Tg is relatively low, compared to conventional toners including polyester.

The glass transition temperature (Tg) is determined using an instrument such as TA-60WS and DSC-60 (both manufactured by Shimadzu Corporation). The measurement conditions are as follows.

Sample container: aluminum sample pan (having a cover)

Sample amount: 5 mg

Reference: aluminum sample pan containing 10 mg of alumina

Atmosphere: Nitrogen gas (flow rate of 50 ml/in)

Temperature conditions:

Starting temperature: 20° C.

Temperature rising speed: 10° C./min

Finishing temperature: 150° C.

Holding time: None

Temperature decreasing speed: 10° C./min

Finishing temperature: 20° C.

Holding time: None

Temperature rising speed: 10° C./min

Finishing temperature: 150° C.

The measurement result is analyzed with a data analysis software TA-60 version 1.52. A peak temperature is determined with a peak analysis function of the software by analyzing a DrDSC curve (i.e., differential curve of DSC curve) obtained in the second temperature rising scan, within a temperature range of from 5° C. lower to 5° C. higher than a temperature at which the maximum peak is observed in the lowest temperature.

A maximum endothermic temperature is determined with a peak analysis function of the software by analyzing a DSC curve obtained in the second temperature rising scan, within a temperature range of from 5° C. lower to 5° C. higher than the peak temperature determined above. The maximum endothermic temperature represents the glass transition temperature (Tg) of the toner.

Surface Treatment of Colorant

Other than the rosin treatment, the surface of the colorant may be sulfonated for the purpose of toner shape control. The colorant can react with a typical sulfonating agent in a solvent which has no reactivity with the sulfonating agent and in which the colorant is insoluble or hardly soluble. Specific examples of the sulfonating agents include, but are not limited to, sulfuric acid, fuming sulfuric acid, sulfuric trioxide, chlorosulfric acid, fluorosulfric acid, amidesulfric acid, etc. When the above sulfonating agents has too strong a reactivity, or when strong acid is not preferably used, a complex of sulfuric trioxide and a tertiary amine can be used as a sulfonating agent. Lewis acids (e.g., aluminum chloride, tin chloride) can be optionally used as a catalyst. The kind of solvent, reaction temperature, reaction time, the kind of sulfanating agent, and the like are determined depending on the kind of the colorant or reaction used.

Colorant Dispersing Agent

The colorant for use in the present invention can be used in combination with a colorant dispersing agent. Suitable colorant dispersing agent has an acid value of not greater than 30 mgKOH/g and an amine value of from 1 to 100 mgKOH/g, and preferably an acid value of not greater than 20 mgKOH/g and an amine value of from 10 to 50 mgKOH/g. When the acid value i s too large, chargeability of the resultant toner deteriorates under high humidity condition, and dispersibility of the colorant also deteriorates. When the amine value is too small or too large, dispersibility of the colorant deteriorates. The acid value can be measured by a method based on JIS K0070, and the amine value can be measured with a method based on JIS K7237. The colorant dispersing agent preferably has high compatibility with binder resin in terms of improving dispersibility of the colorant.

Specific examples of the colorant dispersing agents include, but are not limited to, AJISPER®PB-711, PB-821, PB-822, and PB-824 (from Ajinomoto Fine-Techno Co. Inc.); DISPERBYK® 112, 116, 161, 162, 163, 164, 166, 167, 168, 2000, 2001, 2050, 2070, 2150, and 9077 (from BYK-Chemie); EFKA®4008, 4009, 4010, 4046, 4047, 4520, 4015, 4020, 4050, 4055, 4060, 4080, 4300, 4330, 4400, 4401, 4402, 4403, 4406, and 4510 (from Ciba Specialty Chemicals); etc.

The toner preferably includes the colorant dispersing agent in an amount of from 0.1% by weight to 10% by weight, based on the colorant. When.the amount is too small, dispersibility of the colorant deteriorates. When the amount is too large, chargeability of the toner deteriorates under high humidity conditions. The colorant dispersing agent preferably has a weight average molecular weight, based on styrene determined by gel permeation chromatography, of not less than 2,000, more preferably not less than 3,000, much more preferably from 5,000 to 50,000, and most preferably from 5,000 to 30,000, in terms of improving colorant dispersibility. When the weight average molecular weight is too small, the colorant has too high a polarity, resulting in deterioration of dispersibility thereof When the weight average molecular weight is too large, the colorant has too high a compatibility with the solvent used, resulting in deterioration of dispersibility thereof.

The colorant dispersing agent is preferably added in an amount of from 1 to 50 parts by weight, and more preferably from 5 to 30 parts by weight, based on 100 parts by weight of the colorant. When the amount is too small, the resultant colorant dispersibility deteriorates. When the amount is too large, chargeability of the resultant toner deteriorates. The above colorant dispersing agents can be used alone or in combination with the other dispersing agents. Specific examples of the dispersing agents which can be used in combination with the above colorant dispersing agents include, but are not limited to, polyester-based dispersing agents, polymers of acrylic acids and methacrylic acids and/or esters thereof, derivatives of colorants, etc.

When a colorant which is treated with an acid, and a colorant dispersing agent having specific acid value and amine value are used in combination, amine sites of the colorant dispersing agent adsorb to the acid surface of the colorant. Thereby, the amine sites, which tend to impart positive chargeability to the resultant toner, tend not to exist near the surface of the resultant toner. In contrast, acid sites of the colorant dispersing agent tend to exist near the surface of the resultant toner. Even if the colorant dispersing agent has no acid site, the resultant toner hardly deteriorates negative chargeability because the amine sites of the colorant dispersing agent adsorb to the acid surface of the colorant.

In order to improve affinity between the colorant and the colorant dispersing agent so that the colorant is stably dispersed, colorant derivatives having high affinity for the colorant can be used. Specific examples of the colorant derivatives include, but are not limited to, carboxylic acid derivatives of dimethylaminoethyl quinacridone, dihydroxy quinacridone, and anthraquinone; sulfonic acid derivatives of anthraquinone; SOLSPERSE®22000 (from Avecia Limited); EFKA 6750 (from Ciba Specialty Chemicals); etc. The colorant derivative is preferably added in an amount of from 0.1 to 100% by weight, and more preferably from 0.1 to 10% by weight, based on the colorant.

Master Batch

The colorant for use in the present invention can be combined with a resin to be used as a master batch. Specific examples of the resin for use in the master batch or for use in combination with master batch include, but are not limited to, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Colorant Dispersion Liquid

The colorant is dispersed in an organic solvent to prepare a colorant dispersion liquid in the toner manufacturing process of the present invention. The mixing ratio of the colorant to the organic solvent is preferably from 5/95 to 50/50 by weight. When the mixing ratio is too small, a large amount of the colorant dispersion liquid is needed in the toner manufacturing process, resulting in deterioration of toner manufacturing efficiency. When the mixing ratio is too large, dispersibility of the colorant deteriorates. The colorant may be dispersed in the organic solvent alone or together with the binder resin in order to increase viscosity of the colorant dispersion liquid so that a proper shear force is applied to the colorant.

The colorant particle dispersed in the colorant dispersion liquid preferably has a particle diameter of not greater than 1 μm. When the particle diameter is too large, the colorant has too large a dispersion particle diameter in the resultant toner, resulting in deterioration of produced image quality and transparency of OHP images. The particle diameter of the colorant in the dispersion liquid is measured with a particle size analyzer using Laser Doppler method such as UPA-150 (manufactured by Nikkiso Co., Ltd.).

Release Agent

Any known waxes can be used as a release agent in the present invention. Specific examples of the waxes include, but are not limited to, polyolefin waxes (e.g., polyethylene waxes and polypropylene waxes), hydrocarbons having a long chain (e.g., paraffin waxes and SASOL waxes), and waxes having a carbonyl group. Among these, waxes having a carbonyl group are preferably used. Specific examples of the waxes having a carbonyl group include, but are not limited to, esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

The wax typically has a melting point of from 40 to 160° C., preferably from 50 to 120° C., and more preferably from 60 to 90° C. When the melting point is too low, thermostable preservability of the toner deteriorates. When the melting point is too high, the toner tends to cause a cold offset when the toner is fixed at low temperature. The wax preferably has a viscosity of from 5 to 1000 cps, and more preferably from 10 to 100 cps, at a temperature of 20° C. higher than the melting point thereof. When the viscosity is too high, hot offset resistance and low temperature fixability of the toner deteriorates. The toner typically includes a wax in an amount of from 0 to 40% by weight, and preferably from 3 to 30% by weight.

The melting point (Tm) of the wax is determined by differential scanning calorimetry (DSC), using an instrument such as TA-60WS and DSC-60 (both manufactured by Shimadzu Corporation). The melting point (Tm) is defined as a temperature at which the largest endothermic peak is observed in the DSC curve. The measurement conditions are as follows.

Sample container: aluminum sample pan (having a cover)
Sample amount: 5 mg
Reference: aluminum sample pan containing 10 mg of alumina
Atmosphere: Nitrogen gas (flow rate of 50 ml/in)
Temperature conditions:
- Starting temperature: 20° C.
- Temperature rising speed: 10° C./min
- Finishing temperature: 150° C.
- Holding time: None
- Temperature decreasing speed: 10° C./min
- Finishing temperature: 20° C.
- Holding time: None
- Temperature rising speed: 10° C./min
- Finishing temperature: 150° C.

The measurement result is analyzed with a data analysis software TA-60 version 1.52. A peak temperature is determined with a peak analysis function of the software by analyzing a DrDSC curve (i.e., differential curve of DSC curve) obtained in the second temperature rising scan, within a temperature range of from 5° C. lower to 5° C. higher than a temperature at which the maximum peak is observed in the lowest temperature.

A maximum endothermic temperature is determined with a peak analysis function of the software by analyzing a DSC curve obtained in the second temperature rising scan, within a temperature range of from 5° C. lower to 5° C. higher than the peak temperature determined above. The maximum endothermic temperature represents the melting point (Tm) of the wax.

Charge Controlling Agent

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of the marketed products of the charge controlling agents include, but are not limited to, BONTRON® N-03 (Nigrosine dyes), BONTRON® P-51 (quaternary ammonium salt) BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co. Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG;

LRA-901, and LR-147 (boron complex) which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10% by weight, and preferably from 0.2 to 5% by weight, based on the binder resin included in the toner. When the content is too high, the toner has too large a charge quantity, and thereby the electrostatic force of a developing roller attracting the toner increases, resulting in deterioration of the fluidity of the toner and image density of the toner images. The charge controlling agent can be melt-kneaded with a master batch or a binder resin, or directly dissolved in an organic solvent, or fixed on the surface of the toner.

Particulate Resin

Particulate resin can be added in the toner particle formation process in order to control the toner shape (such as circularity and shape factor) and the particle diameter distribution. The particulate resin for use in the toner of the present invention preferably has a glass transition temperature of from 30 to 70° C., and a weight average molecular weight of from 8,000 to 400,000. When the glass transition temperature is too small and/or the weight average molecular weight it too small, thermostable preservability of the toner deteriorates, resulting in occurrence of toner blocking in the developing device. When the glass transition temperature is too large and/or the weight average molecular weight it too large, the particulate resin tends to inhibit the toner fixation to a paper, resulting in deterioration of low temperature fixability.

It is important that the resultant toner includes the particulate resin remaining on the surface thereof in an amount of from 0.5 to 5.0% by weight. When the remaining amount is too small, thermostable preservability of the toner deteriorates, resulting in occurrence of toner blocking in the developing device. When the remaining amount is too large, the particulate resin tends to inhibit the wax exuding from the toner, resulting in occurrence of hot offset.

The amount of the remaining particulate resin can be *determined by pyrolysis gas chromatography, by calculating an area of a peak specific to the materials originated from the particulate resin. As a detector, mass spectrometer is preferably used, but is not limited thereto.

Any known resins capable of forming an aqueous dispersion thereof can be used for the particulate resin of the present invention, and are not particularly limited. Both thermoplastic resins and thermosetting resins can be used. Specific examples of the resins for use in the particulate resin include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used because these resins can easily form an aqueous dispersion of fine particles thereof.

The particulate resin preferably has a volume average particle diameter of from 5 to 500 nm. When the volume average particle diameter is too small, the particulate resin remaining on the surface of the toner form a thin film thereof or densely cover the surface of the toner. As a result, the particulate resin tends to inhibit fixation of the toner (i.e., binder resin) resulting in deterioration of low temperature fixability. In addition, it is difficult to control particle diameter and shape of the toner. When the volume average particle diameter is too large, each of the particles of the particulate resin form convexities on the surface of the toner or form multiple layers thereof sparsely cover the surface of the toner. Such particles of the particulate resin tend to release from the toner when the toner is agitated in the developing unit. The particle diameter of the particulate resin is measured with a particle size analyzer using Laser Doppler method MICROTRAC® UPA-150 (manufactured by Nikkiso Co., Ltd.). The measurement method is as follows:

(1) a dispersion of a particulate resin is diluted with ion-exchange water so that the dispersion has a concentration of 0.6 (any number between 0.5 to 1.0) % on a solid basis;
(2) the dispersion is subjected to a measurement under the following conditions:
Distribution display: volume
Channel number: 52
Measurement time: 30 sec
Refractive index of sample: 1.81
Temperature: 25° C.
Sample shape: non-spherical
Viscosity (cP): 0.8750
Refractive index of solvent: 1.333
Solvent: water; and
(3) the dispersion is added using a dropper or a syringe so that the measurement instrument indicate "sample LOADING" of from 1 to 100.

Specific examples of the vinyl resins for use in the particulate resin include, but are not limited to, homopolymers and copolymers of vinyl monomers such as styrene-(meth)acrylate copolymers, styrene-butadiene copolymers, (meth) acrylic acid-acrylate copolymers, styrene-acrylonitrile copolymers, styrene-maleic anhydride copolymers, styrene-(meth)acrylic acid copolymers, etc.

Particulate Inorganic Material

The toner of the present invention may include a particulate inorganic material to improve thermostable preservability and chargeability thereof. Particulate inorganic materials having a primary particle diameter of from 0.5 to 200 nm, and preferably from 0.5 to 50 nm, are preferably used. The surface area of the particulate inorganic materials is preferably from 20 to 500 $m^2/g$ when measured by BET method. The content of the particulate inorganic material is preferably from 0.01% to 5.0% by weight, and more preferably from 0.01% to 2.0% by weight, based on the total weight of the toner. Specific examples of such particulate inorganic materials include, but are not limited to, tricalcium phosphate, colloidal silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, rediron oxide, antimony trioxide, magnesium oxide, zirconium oxide, barium sulfate, barium carbonate, calcium carbonate, silicon carbide, silicon nitride, hydroxyapatite, etc.

BET Specific Surface Area

The toner of the present invention preferably has a BET specific surface area of from 0.5 to 6.0 $m^2/g$. When the BET specific surface area is too small, it means that the toner includes coarse particles and the external additives tend to be buried, resulting in deterioration of image density. When the BET specific surface area is too large, it means that the toner includes fine particles and the external additives tend not be firmly fixed and the surface of the toner has concavities and convexities, resulting in deterioration of image density. The BET specific surface area is determined with an instrument complying with JIS Z8830 and R1626, such as NOVA series manufactured by Yuasa Ionics Inc.

External Additive

Toner particles are preferably mixed with an external additive to improve fluidity, developability of the toner. Inorganic fine particles are typically used as the external additive. Particulate inorganic materials having a primary particle diameter of from 5 nm to 2 μm, and preferably from 5 nm to 500 nm, are preferably used. The surface area of the particulate inorganic materials is preferably from 20 to 500 $m^2/g$ when measured by a BET method. The content of the particulate inorganic material is preferably from 0.01% to 5.0% by weight, and more preferably from 0.01% to 2.0% by weight, based on the total weight of the toner. Specific examples of such particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, rediron oxide, antimony trioxide, magnesium oxide, zirconium oxide, barium sulfate, barium carbonate, calcium carbonate, silicon carbide, silicon nitride, etc.

Particles of a polymer selected from polystyrenes, polymethacrylates, and polyacrylate copolymers, which are prepared by a polymerization method, selected from soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include, but are not limited to, silane coupling agents, silylation agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agents include, but are not limited to, fatty acids and their metal salts such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

Particle Diameter

The toner of the present invention preferably has a volume average particle diameter (Dv) of from 3.0 to 8.0 μm; and a ratio (Dv/Dn) between the volume average particle diameter (Dv) and a number average particle diameter (Dn) of from 1.00 to 1.30.

Typically, a toner having a small particle diameter has an advantage in terms of producing high definition and high quality images, but has a disadvantage in terms of transferability and cleanability. When the Dv is too small, the toner tends to fuse on the surface of the carrier by long-term agitation in a developing device, resulting in deterioration of chargeability of a carrier, when the toner is used for a two-component developer. When the toner is used for a one-component developer, problems such that the toner forms a film on a developing roller, and the toner fuses on a toner layer forming member tend to be caused.

In contrast, when the Dv is too large, it is difficult to obtain high definition and high quality images. In addition, an average particle diameter of a toner included in a developer tends to be largely changed when a part of toner particles are replaced with fresh toner particles. When Dv/Dn is too large, the toner has too broad a charge quantity distribution and therefore image resolution deteriorates.

The volume average particle diameter (Dv), number average particle diameter (Dn) and particle diameter distribution of a toner can be measured using an instrument COULTER MULTISIZER III (manufactured by Coulter Electrons Inc.) and an analysis software Beckman Coulter Multisizer 3 Version 3.51.

The measuring method is as follows:

(1) 0.5 ml of a 10% by weight of aqueous solution of a surfactant (i.e., an alkylbenzene sulfonic acid salt NEOGEN SC-A from Dai-ichi Kogyo Seiyaku Co., Ltd) is fed to a 100 ml beaker, and 0.5 g of a toner is added thereto and mixed using a micro spatula;

(2) 80 ml of ion-exchange water is added thereto, and the mixture is dispersed with an ultrasonic dispersing machine (W-113MK-II from Honda Electronics Co., Ltd.) for 10 minutes to prepare a toner dispersion liquid;

(3) a volume and a number of the toner particles is measured with COULTER MULTISIZER III using an aperture of 100 μm and an electrolyte (ISOTON-II from Coulter Electrons Inc. to determine volume and number distribution thereof, by adding the toner dispersion liquid so that the instrument indicates a toner concentration of from 6 to 10%; and (4) the volume particle diameter (Dv) and the weight average particle diameter (Dn) is determined.

It is important that the measurement toner concentration is from 6 to 10% from the viewpoint of reproducibility of the measurement.

Average Circularity

The toner preferably has an average circularity of from 0.95 to 0.995. In this case, the toner has good dot reproducibility and transferability, resulting in producing high quality images. Such a toner having high average circularity has a draw back such that the toner tends to slip on the surface of the friction charging member (such as carrier) resulting in deterioration of charging speed and charging quantity. However, since the toner of the present invention has a specific surface property (i.e., SF-1 and SF-2), the toner has good friction chargeability, developability, and transferability. When the average circularity is too small (i.e., the toner is far from true sphere), the toner has poor transferability and therefore high quality images cannot be produced. Since such toner particles having an irregular form contacts smooth media (such as photoreceptor) at plural convexity points, of which the charges of the toner particles are concentrated at tips thereof, van der Waals' force and image force generated therebetween are larger than these generated between spherical toner particles and the smooth media. When the toner includes both irregular particles and spherical particles, the spherical particles are selectively transferred, and therefore image deficit tends to be occurred in character parts and line parts. Since toner particles remaining on the image bearing member have to be removed so as to prepare for the next developing process, the image forming apparatus needs a cleaning device. A minimum amount of the toner needed for an image forming increases, resulting in deterioration of toner yield.

The average circularity of a toner can be determined using a flow-type particle image analyzer FPIA-2100 (manufactured by Sysmex Corp.) and an analysis software FPIA-2100 Data Processing Program for FPIA version 00-10.

Specifically, the method is as follows:

(1) 0.1 to 0.5 ml of a 10% by weight of aqueous solution of a surfactant (i.e., an alkylbenzene sulfonic acid salt NEOGEN SC-A from Dai-ichi Kogyo Seiyaku Co., Ltd) is fed to a 100 ml beaker, and 0.1 to 0.5 g of a toner is added thereto and mixed using a micro spatula;

(2) 80 ml of ion-exchange water is added thereto, and the mixture is dispersed with an ultrasonic dispersing machine (W-113MK-II from Honda Electronics Co., Ltd.) for 3minutes to prepare a toner dispersion including particles of 5,000 to 15,000 per micro-liter of the dispersion;

(3) the average circularity and circularity distribution of the sample in the toner dispersion liquid are determined by the measuring instrument mentioned above.

It is important that the dispersion includes toner particles of from 5,000 to 15,000 per micro-liter. This toner particle concentration can be controlled by changing the amount of the dispersant and the toner included in the dispersion. The needed amount of the dispersant depends on hydrophobicity of the toner. When the amount of the dispersant is too large, bubbles are formed in the dispersion, resulting in background noise of the measurement. When the amount of the dispersant is too small, toner particles cannot sufficiently get wet, resulting in deterioration of dispersibility. On the other hand, the needed amount of the toner depends on the particle diameter thereof. As the particle diameter decreases, the needed amount of the toner decreases. When the toner has a particle diameter of from 3 to 7 μm, it is preferable to add from 0.1 to 0.5 g of the toner so as to prepare a dispersion including toner particles of 5,000 to 15,000 per micro-liter of the dispersion.

The toner dispersion passes through a flow path made of a flat transparent flow cell (having a thickness of about 200 μm). A strobe light is arranged on one side of the flow cell and a CCD camera is arranged on the opposite side of the flow cell so that an optical path is formed across the thickness direction of the flow cell. The strobe light flashes at every 1/30 seconds while the toner dispersion is passing through the flow path to capture toner images. The toner particles are photographed as a two-dimensional image having a certain area parallel to the flow cell. A diameter of a circle having the same area as that of the image of the particle (this diameter is hereinafter referred to as CE diameter) is calculated and treated as a particle diameter of the particle. Within about 1 minute, the CE diameters of 1200 or more particles can be calculated, and the CE diameter distribution can be obtained. Particles having a CE diameter of from 0.06 to 400 μm are divided into 226 channels (1 octave is divided into 30 channels). In the present invention, particles having a CE diameter of from 0.60 to 159.21 μm are used to calculate the average circularity.

Toner Manufacturing Method

As mentioned above, the toner of the present invention is manufactured by a method using an aqueous medium. Among such manufacturing methods, dissolution suspension method is preferably used, and the following method is more preferably used:

dissolving or dispersing at least a polymer capable of reacting with an active hydrogen (i.e., a precursor of a binder resin) and a colorant, in an organic solvent to prepare a toner constituent mixture liquid;

dispersing the toner constituent mixture liquid in an aqueous medium while subjecting the polymer to a reaction with a compound having an active hydrogen, to prepare a dispersion including toner particles; and removing the organic solvent from the dispersion, followed by washing and drying.

This method will be explained in detail. However, the toner manufacturing method is not limited thereto.

The aqueous medium contains a particulate resin. Suitable aqueous media include water. In addition, other solvents which can be mixed with water can be added to water. Specific examples of such solvents include, but are not limited to, alcohols such as methanol, isopropanol and ethylene glycol; dimethylformamide, tetrahydrofuran, cellosolves such as methyl cellosolve, lower ketones such as acetone and methyl ethyl ketone, etc.

Toner particles are obtained by subjecting a polyester prepolymer (A) having an isocyanate group, which is dissolved or dispersed in an organic solvent, with an amine (B) in the aqueous medium. The organic solvent in which the polyester prepolymer (A) and other toner constituents are dissolved or dispersed is stably dispersed in the aqueous medium by application of shear force. Toner constituents other than the polyester prepolymer (A) (such as colorant, colorant master batch, release agent, and charge controlling agent) can be added to the aqueous medium when the organic solvent in which the polyester prepolymer (A) is dissolved or dispersed is dispersed therein. However, it is preferable that all of the toner constituents are dissolved or dispersed in the organic solvent together with the prepolymer (A) before forming dispersion thereof in the aqueous medium. However, toner constituent such as colorant, release agent, and charge controlling agent do not have to add to the organic solvent, and are optionally mixed with the toner particles after finishing formation thereof. For example, colorless resin particles (i.e., including no colorant) can be dyed by any known method so that the particles include a colorant.

The polyester prepolymer (A) is prepared as follows:

(1) a polyol (1) and a polycarboxylic acid (2) are reacted at a temperature of from 150 to 280° C. in the presence of an esterification catalyst (such as tetrabutoxy titanate and dibutyl tin oxide), optionally removing produced water under reduced pressure, to prepare a polyester having a hydroxyl group; and (2) the polyester is reacted with a polyisocyanate (3) so that a prepolymer (A) having an isocyanate group is prepared.

As the dispersing machine, known mixers and dispersing machines such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is generally 0 to 150° C. (under pressure), and preferably from 40 to 98° C. It is preferable that the temperature is relatively high because the polyester prepolymer (A) has low viscosity, and therefore the polyester prepolymer (A) can be easily dispersed.

The content of the aqueous medium to 100 parts by weight of the toner constituent mixture liquid is typically from 50 to 2,000 parts by weight, and preferably from 100 to 1,000 parts by weight. When the content is too small, the toner constituent mixture liquid cannot be well dispersed, and therefore the toner cannot have a desired particle diameter. When the content is too large, economical efficiency of the toner manufacturing method deteriorates.

When the toner constituent mixture liquid is emulsified and dispersed in an aqueous medium, dispersants are preferably used to improve stability of the dispersion.

Specific examples of the dispersants include anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amine derivatives, polyhydric alcohol derivatives; and ampholytic surfactants such as aniline, dodecyldi(aminoethyl)glycin, di(octylaminoethyl)glycin, and N-alkyl-N,N-dimethylammonium betaine, but are not limited thereto.

By using a fluorine-containing surfactant as the surfactant, good charging properties and good charge rising property can be imparted to the resultant toner. Specific examples of anionic surfactants having a fluoroalkyl group include, but are not limited to, fluoroalkyl carboxylic acids having from 2 to 10 carbon atoms and their metal salts; disodium perfluorooctanesulfonylglutamate, sodium 3-{ω-fluoroalkyl(C6-C11)oxy}-1-alkyl(C3-C4)sulfonate, sodium 3-{ω-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonylglycin, monoperfluoroalkyl(C6-C16)ethylphosphates, etc.

Specific examples of the marketed products of such surfactants include, but are not limited to, SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE®F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants having a fluoroalkyl group include, but are not limited to, primary, secondary and tertiary aliphatic amines having a fluoroalkyl group, aliphatic quaternary salts such as perfluoroalkyl(C6-C10)sulfoneamidepropyltrimethylammonium salts, benzalkonium salts, benzetonium chloride, pyridinium salts, imidazolinium salts, etc.

Specific examples of the marketed products thereof include, but are not limited to, SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, inorganic dispersants, which are insoluble in water, such as tricalcium phosphate, calcium carbonate, titanium oxide, colloidal silica and hydroxyapatite can also be used.

Further, it is possible to stably disperse the toner constituent mixture liquid in an aqueous medium using a polymeric protection colloid. Specific examples of such protection colloids include, but are not limited to, polymers and copolymers prepared using monomers such as acids (e.g., acrylic acid, methacrylic acid, α-cyano acrylic acid, α-cyano methacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinylpyrrolidone, vinyl imidazole and ethylene imine) In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds soluble to both acids and bases, such as calcium phosphate salts, are used as a dispersant, it is preferable that the dispersant is dissolved by acids such as hydrochloric acid or bases such as sodium hydroxide, followed by washing with water. Enzymes are also usable to remove the dispersant.

The reaction between the prepolymer (A) and the amine (B) is a crosslinking reaction and/or an elongation reaction of polymer chains. The reaction time is determined depending on the reactivity of the isocyanate of the prepolymer (A) used with the amine (B) used. However, the reaction time is typically from 10 minutes to 40 hours, and preferably from 2 to 20 hours. The reaction temperature is typically from 0 to 150° C. and preferably from 40 to 98° C. In addition, known catalysts such as dibutyl tin laurate and dioctyl tin laurate can be added, if desired, when the reaction is performed.

In order to remove an organic solvent from the emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can be used. Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When particles in the emulsion have a wide particle diameter distribution, and the particle diameter distribution is not changed even after the particles are subjected to washing and drying treatment, particles can be classified to have a target particle diameter distribution.

The particles can be classified by removing fine particles by methods such as cyclone, decantation, centrifugal separation, etc. in a liquid. Of course, the dried particles can be classified by the above methods. However, the classification is preferably preformed in a liquid from the viewpoint of efficiency. Removed fine particles and coarse particles can be recycled in toner particle formation process. The removed fine particles and coarse particles may be wet.

The dispersing agent used in the emulsion is preferably removed therefrom in the classification process.

The dried toner particles can be mixed with other particulate materials such as release agent, charge controlling agent, fluidizer, colorant, etc., optionally upon application of a mechanical impact thereto to fix and fuse the particulate materials on the surface of the toner particles.

Specific examples of such mechanical impact application methods include, but are not limited to, methods in which a mixture is mixed with a highly rotated blade and methods in which a mixture is put into an air to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

Two-component Developer

When the toner of the present invention is used for a two-component developer, the toner is mixed with a magnetic carrier. The two-component developer preferably includes the toner in an amount of from 1 to 10 parts by weight, based on 100 parts of the magnetic carrier. Any known carriers such as iron powders, ferrite powders, magnetite powders, and magnetic resin carriers, having a particle diameter of from 20 to 200 μm can be used.

Specific examples of resins for use in the cover layer of the carrier include, but are not limited to, amino resins (e.g., urea-formaldehyde resins, melamine resins, benzoguanamine resins, urea resins, polyamide resins, epoxy resins), polyvinyl and polyvinylidene resins (e.g., acrylic resins, polymethyl methacrylate, polyacrylonitrile, polyvinyl acetate, polyvinyl alcohol, polyvinyl butyral), polystyrene resins (e.g., polystyrene, styrene-acrylic copolymer), halogenated olefin resins(e.g., polyvinyl chloride),polyester resins (e.g., polyethylene terephthalate, polybutylene terephthalate), polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers (e.g., terpolymer of tetrafluoroethylene and vinylidene fluoride and non-fluoridemonomer), silicone resins, etc.

The resins for use in the cover layer of the carrier optionally include conductive particulate materials. Specific examples of the conductive materials include, but are not limited to, metal powders, carbon black, titanium oxide, tin oxide, zinc oxide, etc. The conductive particulate material preferably has an average particle diameter of not greater than 1 μm. When the average particle diameter is too small, it is difficult to control the electrical resistance of the carrier.

The toner of the present invention can be used as a one-component magnetic or non-magnetic toner which does not use a carrier.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Particulate Resin

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were contained and the mixture was agitated with the stirrer for 15 minutes at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion (i.e., particle dispersion (1)) of a vinyl resin (i.e., a copolymer of styrene/methacrylic acid/butyl acrylate/sodium salt of sulfate of ethylene oxide adduct of methacrylic acid) was prepared.

The particulate vinyl resin had a volume average particle diameter of 105 nm determined by a laser diffraction and scattering type particle size distribution analyzer LA-920 (manufactured by Horiba Ltd.). A part of the particle dispersion (1) was dried to isolate the resin. The resin had a glass transition temperature (Tg) of 59° C., and a weight average molecular weight (Mw) of 150,000.

Preparation of Water Phase 990 parts of water, 83 parts of the particle dispersion (1) prepared above, 37 parts of an aqueous solution of a sodium salt of dodecyldiphenyletherdisulfonic acid (ELEMINOL MON-7 (trademark) from Sanyo Chemical Industries Ltd., solid content of 48.5%), and 90 parts of ethyl acetate were mixed. As a result, a water phase (1) was prepared.

Preparation of Low Molecular Weight Polyester

The following components were fed in a reaction vessel equipped with a condenser, a stirrer and a nitrogen feed pipe.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The mixture was reacted for 8 hours at 230° C. under normal pressure.

Then the reaction was further continued for 5 hours under a reduced pressure of 10 to 15 mmHg.

Further, 44 parts of trimellitic anhydride was fed to the container to be reacted with the reaction product for 2 hours at 180° C. Thus, a low molecular weight polyester (1) was prepared.

The low molecular weight polyester (1) had a number average molecular weight (Mn) of 2,500, a weight average molecular weight (Mw) of 6,700, a glass transition temperature (Tg) of 43° C., and an acid value of 25.

Preparation of Prepolymer

The following components were fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 8 hours at 230° C. under normal pressure.

Then the reaction was further continued for 5 hours under a reduced pressure of 10 to 15 mmHg. Thus, an intermediate polyester resin (1) was prepared.

The intermediate polyester (1) had a number average molecular weight (Mn) of 2,100, a weight average molecular weight (Mw) of 9,500, a glass transition temperature (Tg) of 55° C., an acid value of 0.5 mgKOH/g, and a hydroxyl value of 51 mgKOH/g.

In a reaction vessel equipped with a condenser, a stirrer and a nitrogen feedpipe, 410 parts of the intermediate polyester resin (1), 89 parts of isophorone diisocyanate and 500 parts of ethyl acetate were mixed and the mixture was heated at 100° C. for 5 hours to perform the reaction. Thus, a polyester prepolymer (1) having an isocyanate group was prepared. A content of free isocyanate in the prepolymer (1) was 1.53% by weight.

Synthesis of Ketimine Compound

In a reaction vessel equipped with a stirrer and a thermometer, 170 parts of isophorone diamine and 75 parts of methyl ethyl ketone were mixed and reacted for 5 hours at 50° C. to prepare a ketimine compound (1). The ketimine compound (1) had an amine value of 418 mgKOH/g.

Preparation of Surface-treated Colorant (1)

The following components were kneaded for 3 hours with a three-roll mill.

| | |
|---|---|
| PALIOTOL ® YELLOW D1155 (from BASF Aktiengesellschaft) | 250 parts |
| Sodium chloride | 700 parts |
| Rosin-modified maleic acid resin | 25 parts |
| Polyethylene glycol | 160 parts |

The kneaded mixture was put into about 3 liters of hot water and agitated for 1 hour with a high-speed mixer at 80° C. As a result, a slurry was prepared. The slurry was subjected to filtration and water washing to remove the sodium chloride and the polyethylene glycol, and then vacuum-dried for 24 hours in a hot-air oven at 60° C. Thus, a surface-treated colorant (1) was prepared.

Preparation of Master Batch (1)

The following components were mixed with HESCHEL MIXER (manufactured by Mitsui Mining Co., Ltd.).

| | |
|---|---|
| Water | 1200 parts |
| Surface-treated colorant (1) | 540 parts |
| Polyester resin | 1200 parts |

The mixture was kneaded for 30 minutes at 150° C. with a two-roll mill, and then subjected to rolling and cooling. The rolled mixture was pulverized using a pulverizer. Thus, a master batch (1) was prepared.

Preparation of Oil Phase Liquid

In a reaction vessel equipped with a stirrer and a thermometer, 378 parts of the low molecular weight polyester (1), 110 parts of a carnauba wax, 22 parts of a charge controlling agent (a metal complex of salicylic acid E-84 from Orient Chemical Industries, Ltd.), and 947 parts of ethyl acetate were mixed and the mixture was heated to 80° C. while agitated. After being heated at 80° C. for 5 hours, the mixture was cooled to 30° C. over 1 hour. Then 500 parts of the master batch (1) and 500 parts of ethyl acetate were added to the vessel, and the mixture was agitated for 1 hour to prepare a raw material dispersion (1).

Then 1324 parts of the raw material dispersion (1) were subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the low molecular weight polyester (1) prepared above was added thereto. The mixture was subjected to the dispersion treatment using the bead mill. The dispersion conditions are the same as those mentioned above except that the dispersion operation was performed once (i.e., one pass).

Thus, a colorant/wax dispersion (1) was prepared. A solid content of the colorant/wax dispersion (1) was 50% at 130° C., 30 minutes.

Emulsification

Then the following components were mixed in a vessel.

| | |
|---|---|
| Colorant/wax dispersion (1) prepared above | 749 parts |
| Prepolymer (1) prepared above | 115 parts |
| Ketimine compound (1) prepared above | 2.9 parts |

The components were mixed for 1 minute using a mixer TK HOMOMIXER (trademark) from Tokushu Kika Kogyo K.K. at a revolution of 5,000 rpm. Thus, an oil phase liquid (1) was prepared.

Then 1200 parts of the water phase (1) prepared above was added thereto. The mixture was agitated for 20 minutes with a mixer TK HOMOMIXER (trademark) at a revolution of 13,000 rpm. As a result, an emulsion (1) was prepared.

Solvent Removal

The emulsion (1) was fed into a container equipped with a stirrer and a thermometer, and the emulsion was heated for 8 hours at 30° C. to remove the organic solvent (ethyl acetate)

from the emulsion. Then the emulsion was aged for 4 minutes at 45° C. Thus, a dispersion (1) was prepared.

The particles included in the dispersion (1) had a volume average particle diameter of 4.95 μm and a number average particle diameter of 5.45 μm (measured with MULTISIZER II).

Washing and Drying

One hundred (100) parts of the dispersion (1) was filtered = under a reduced pressure.

The thus obtained wet cake was mixed with 100 parts of ion-exchange water and the mixture was agitated for 10 minutes with a TK HOMOMIXER at a revolution of 12,000 rpm, followed by filtering. Thus, a wet cake (1) was prepared.

The wet cake (1) was mixed with a 10%.aqueous solution of hydrochloric acid so that the wet cake (1) had a pH of 2.8, and the mixture was agitated for 10 minutes with a TK HOMOMIXER at a revolution of 12,000 rpm, followed by filtering. Thus, a wet cake (2) was prepared.

The wet cake (2) was mixed with 300 parts of ion-exchange water and the mixture was agitated for 10 minutes with a TK HOMOMIXER at a revolution of 12,000 rpm, followed by filtering. This washing operation was performed twice. Thus, a wet cake (3) was prepared.

The wet cake (3) was dried for 48 hours at 45° C. using a circulating air drier, followed by sieving with a screen having openings of 75 μm. Thus, a mother toner (1) was prepared.

Example 2

Preparation of Surface-treated Colorant (2)

The following components were kneaded for 3 hours with a three-roll mill.

| | |
|---|---|
| PALIOTOL ® YELLOW D1155 (from BASF Aktiengesellschaft) | 250 parts |
| Sodium chloride | 700 parts |
| Rosin-modified maleic acid resin | 12 parts |
| Polyethylene glycol | 160 parts |

The kneaded mixture was put into about 3 liters of hot water and agitated for 1 hour with a high-speed mixer at 80° C. As a result, a slurry was prepared. The slurry was subjected to filtration and water washing to remove the sodium chloride and the polyethylene glycol, and then vacuum-dried for 24 hours in a hot-air oven at 60° C. Thus, a surface-treated colorant (2) was prepared.

Preparation of Master Batch (2)

The following components were mixed with HESCHEL MIXER (manufactured by Mitsui Mining Co., Ltd.).

| | |
|---|---|
| Water | 1200 parts |
| Surface-treated colorant (2) | 540 parts |
| Polyester resin | 1200 parts |

The mixture was kneaded for 30 minutes at 150° C. with a two-roll mill, and then subjected to rolling and cooling. The rolled mixture was pulverized using a pulverizer. Thus, a master batch (2) was prepared.

Preparation of Mother Toner

The procedure for preparation of the mother toner in Example 1 was repeated except that the master batch (1) was replaced with the master batch (2). Thus, a mother toner (2) was prepared.

Example 3

Preparation of Master Batch (3)

The following components were mixed with HESCHEL MIXER (manufactured by Mitsui Mining Co., Ltd.).

| | |
|---|---|
| Water | 1200 parts |
| PALIOTOL ® YELLOW D1155 (from BASF Aktiengesellschaft) | 540 parts |
| Polyester resin | 1200 parts |

The mixture was kneaded for 30 minutes at 150° C. with a two-roll mill, and then subjected to rolling and cooling. The rolled mixture was pulverized using a pulverizer. Thus, a master batch (3) was prepared.

Preparation of Mother Toner

The procedure for preparation of the mother toner in Example 1 was repeated except that the master batch (1) was replaced with the master batch (3). Thus, a mother toner (3) was prepared.

Comparative Example 1

Preparation of Master Batch (4)

The following components were mixed with HESCHEL MIXER (manufactured by Mitsui Mining Co., Ltd.).

| | |
|---|---|
| Water | 1200 parts |
| Pigment Yellow 155 (from Clariant Ltd.) | 540 parts |
| Polyester resin | 1200 parts |

The mixture was kneaded for 30 minutes at 150° C. with a two-roll mill, and then subjected to rolling and cooling. The rolled mixture was pulverized using a pulverizer. Thus, a master batch (4) was prepared.

The Pigment Yellow 155 includes no dichlorobenzidine structure. The Pigment Yellow 155 does not have the formula (I).

Preparation of Mother Toner

The procedure for preparation of the mother toner in Example 1 was repeated except that the master batch (1) was replaced with the master batch (4). Thus, a mother toner (4) was prepared.

Comparative Example 2

Preparation of Surface-treated Colorant (3)

The following components were kneaded for 3 hours with a three-roll mill.

| | |
|---|---|
| Pigment Yellow 155 (from Clariant Ltd.) | 250 parts |
| Sodium chloride | 700 parts |
| Rosin-modified maleic acid resin | 25 parts |
| Polyethylene glycol | 160 parts |

The kneaded mixture was put-into about 3 liters of hot water and agitated for 1 hour with a high-speed mixer at 80° C. As a result, a slurry was prepared. The slurry was subjected to filtration and water washing to remove the sodium chloride and the polyethylene glycol, and then vacuum-dried for 24 hours in a hot-air oven at 60° C. Thus, a surface-treated colorant (3) was prepared.

Preparation of Master Batch (5)

The following components were mixed with HESCHEL MIXER (manufactured by Mitsui Mining Co., Ltd.).

| | |
|---|---|
| Water | 1200 parts |
| Surface-treated colorant (3) | 540 parts |
| Polyester resin | 1200 parts |

The mixture was kneaded for 30 minutes at 150° C. with a two-roll mill, and then subjected to rolling and cooling. The rolled mixture was pulverized using a pulverizer. Thus, a master batch (5) was prepared.

Preparation of Mother Toner

The procedure for preparation of the mother toner in Example 1 was repeated except that the master batch (1) was replaced with the master batch (5). Thus, a mother toner (5) was prepared.

Evaluation (1) Chargeability

At first, 100 parts by weight of each of the prepared mother toners were mixed with 1 part by weight of a silica (R972 from Nippon Aerosil Co., Ltd.) for 1 minute using a sample mill to prepare a toner.

Next, 10 g of each of the prepared toners and 100 g of a ferrite carrier were mixed under a condition of 28° C. and 80% RH to prepare a developer. The developer was subjected to measurement using a blow-off method to determine charge quantity.

(2) Particle Diameter

The volume average particle diameter (Dv) and the number average particle diameter (Dn) of each of the prepared toners were determined with a particle analyzer COULTER COUNTER® MULTISIZER™ 3 (manufactured by Coulter Electrons Inc.) using an aperture of 100 μm.

(3) Fixability

The developer prepared above was set in a modified copier IMAGIO NEO 450 (manufactured by Ricoh Co., Ltd.) using a belt fixation method. Solid images having 0.9 to 1.1 mg/cm$^2$ of a toner thereon were produced on plain papers (TYPE6200 from Ricoh Co., Ltd.) or thick papers (Copy Paper 135 from NBS Ricoh Co., Ltd.). The solid images on plain papers were fixed at various temperatures to determine the maximum fixable temperature above which the offset problem occurs. The solid images on thick papers were fixed at various temperatures to determine the minimum fixable temperature below which the residual rate of the image density was less than 70% when the fixed image was rubbed with a pad.

The fixability is graded as follows:

Good: the maximum fixable temperature is 190° C. or more

Poor: the minimum fixable temperature is 140° C. or less (4) Image Density

The developer prepared above was set in a modified copier IMAGIO NEO 450 (manufactured by Ricoh Co., Ltd.) using a belt fixation method. Solid image having 0.9 to 1.1 mg/cm$^2$ of a toner thereon was produced and fixed on plain paper (TYPE6200 from Ricoh Co., Ltd.). The image density of the produced solid image is determined by averaging image densities of five randomly selected portions of the solid image measured with X-RITE 938 from X-rite.

(5) Light Resistance

After measuring the image density (A1) as mentioned above, the solid images was exposed to xenon light (having an illuminance of 765 w/m$^2$) for 25 hours at a temperature of 50° C. using SUNTESTER XF-180CPS (manufactured by Shimadzu Corporation), followed by measuring the image density (A2) by the same method. The residual ratio of the image density is determined by the following equation:

$$A2/A1\times100(\%)$$

wherein A1 represents the image density measured before the exposure to the xenon light, and A2 represents the image density measured after the exposure to the xenon light.

(6) Toner Shape

The shape factors SF-1 and SF-2 were determined by the following method:

(i) particles of a toner were photographed using a scanning electron microscope (FE-SEM S-800 manufactured by Hitachi Ltd) at a magnification of 500 times and an acceleration voltage of 2.5 kV; and (ii) photographic images of 100 randomly selected toner particles were analyzed using an image analyzer (LUZEX III manufactured by Nicolet Corp.) to determine the SF-1 and SF-2.

Figure 2:
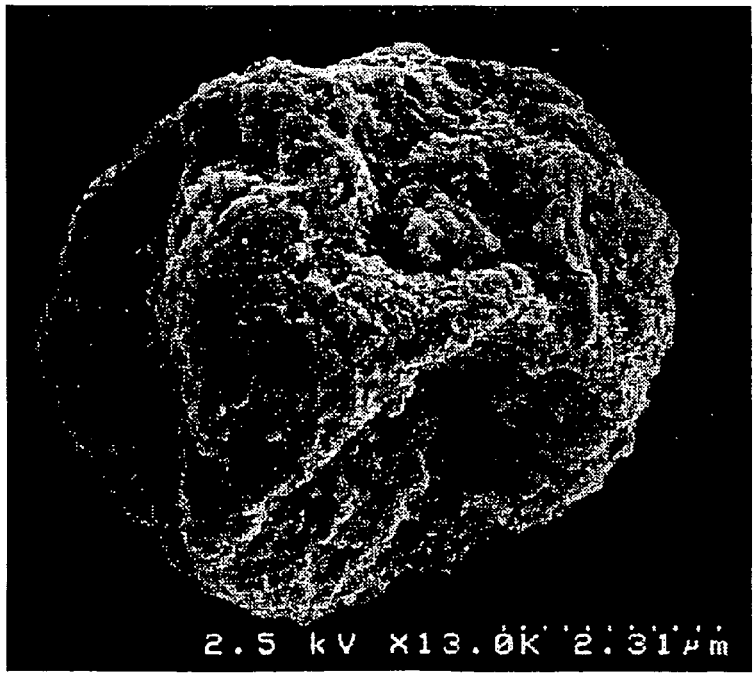
FIGS. 2 and 3 are images of the toner of the present invention obtained by a scanning electron microscope (SEM)
Figure 3:
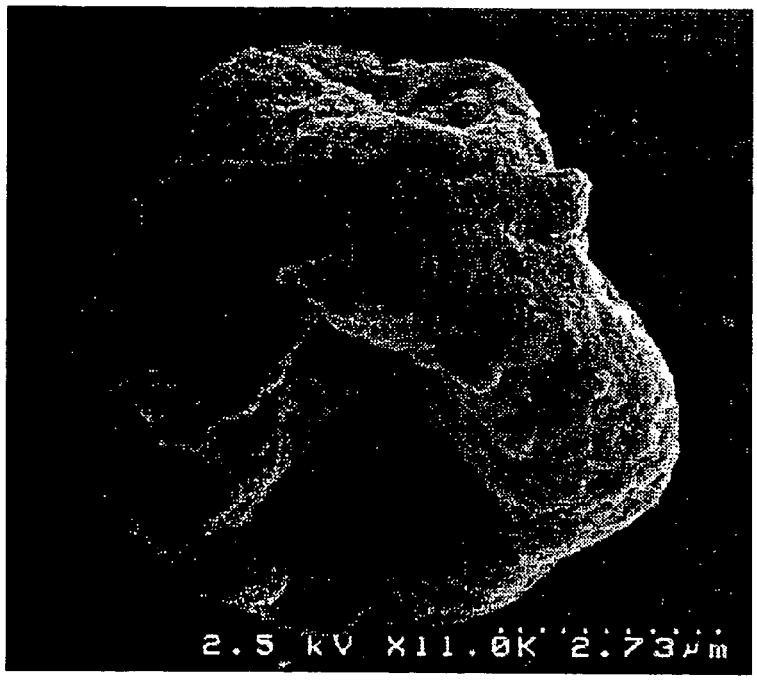
Figure 4:
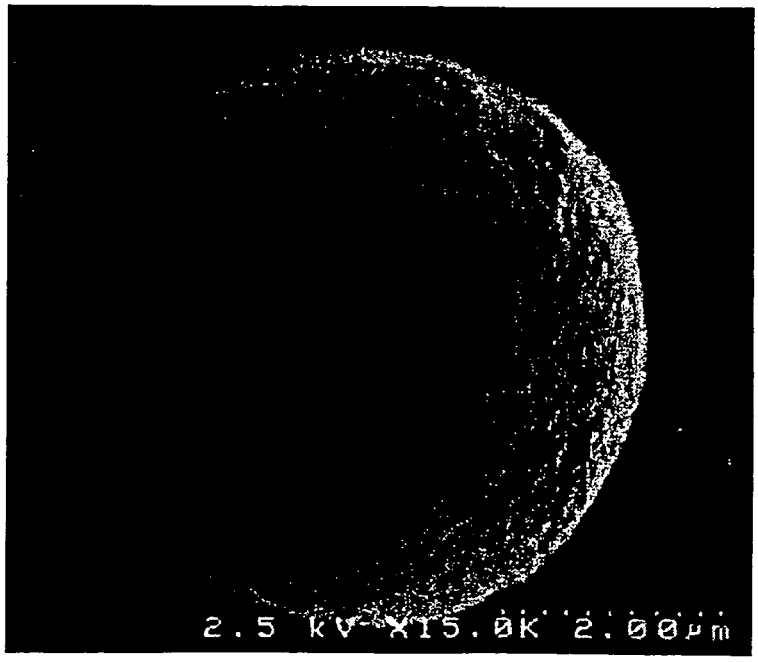
FIGS. 4 is an image of a comparative toner obtained by a scanning electron microscope (SEM)

FIG. 2 is a SEM image of the toner (1) prepared in Example 1, FIG. 3 is a SEM image of the toner (3) prepared in Example 3, and FIG. 4 is a SEM image of the toner (4) prepared in Comparative Example 1. It is clear from FIG. 2 and FIG. 3 that the toner (1) including a surface-treated colorant has less convexities and concavities compared to the toner (3) including a non-treated colorant. The surface-treated colorant tends to disperse inside of the toner and hardly exists at the surface of the toner. It is clear from FIG. 4 that the toner (4) has a nearly spherical shape. The toner (5) prepared in Comparative Example 2 also had a nearly spherical shape. It seems that the colorant Pigment Yellow 155 is dispersed inside of the toner regardless of whether the colorant is surface-treated or not.

(7) Colorant Dispersibility

Figure 5:
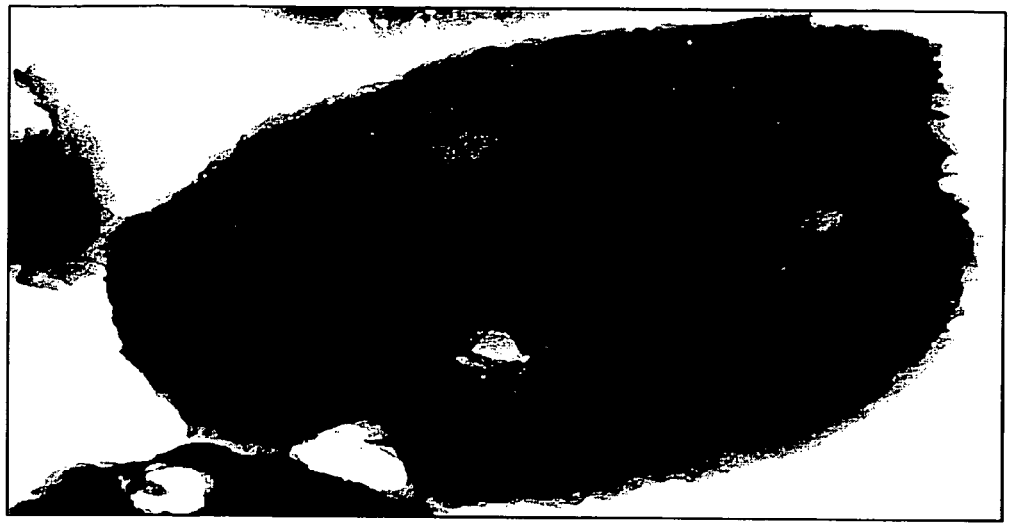
FIGS. 5 and 6 are cross section images of the toner of the present invention obtained by a transmission electron microscope (TEM).
Figure 6:
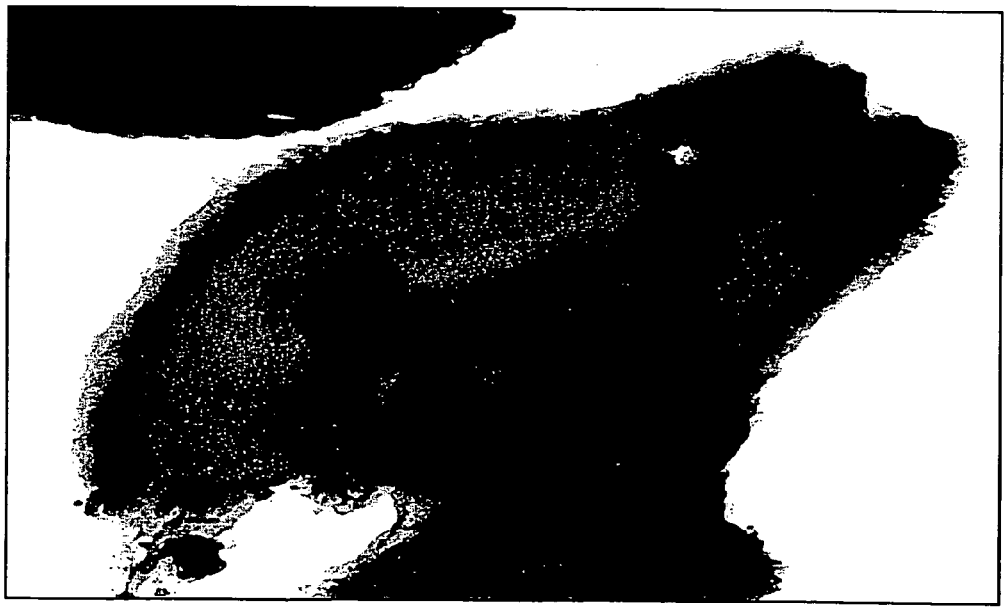

Colorant dispersibility was determined by the following method. Toner particles were embedded in an epoxy resin so as to be cut into an ultrathin section having a thickness of about 100 nm. The thus prepared sample is observed with a transmission electron microscope (TEM) at an acceleration voltage of 15 kV. FIG. 6 is a TEM image of a cross section of the toner (1) prepared in Example 1, and FIG. 5 is a TEM image of a cross section of the toner (3) prepared in Example 3. Small black particles observed in the toner particle represent colorant particles. It is clear from FIG. 5 and FIG. 6 that in the toner (3) including a non-treated colorant, almost all of the observed colorant particles exist at the surface of the toner. In contrast, in the toner (1) including a surface-treated colorant, a large amount of the colorant particles exist inside the toner.

(8) Cleanability

A running test in which 1,000 sheets of an image having an image proportion of 95% were continuously produced was performed. After the photoreceptor was cleaned with a cleaning device, toner particles remaining on the photoreceptor were transferred on a tape (SCOTCH® TAPE from Sumitomo 3M limited) The tape was adhered to a white paper, and then the image density was measured with a Macbeth densitometer RD514.

The cleanability is graded as follows by the difference in image density between the tape and blank (i.e., the white paper):

Very good: less than 0.005

Good: 0.005 to 0.010

Average: 0.011 to 0.02

Poor: greater than 0.02

The evaluation results of each of the toners are shown in Table 1 and Table 2.

TABLE 1

| | Toner No. | Particle diameter Dv (μm) | Dn (μm) | Dv/Dn | Toner shape Average circularity | SF-1 | SF-2 |
|---|---|---|---|---|---|---|---|
| Ex. 1 | (1) | 4.64 | 4.30 | 1.08 | 0.967 | 136 | 125 |
| Ex. 2 | (2) | 4.85 | 4.43 | 1.05 | 0.962 | 140 | 130 |
| Ex. 3 | (3) | 4.87 | 4.64 | 1.05 | 0.957 | 142 | 137 |
| Comp. Ex. 1 | (4) | 5.16 | 4.72 | 1.09 | 0.973 | 108 | 105 |
| Comp. Ex. 2 | (5) | 4.86 | 4.42 | 1.10 | 0.977 | 110 | 106 |

TABLE 2

| | Toner No. | Charge quantity (−μC/g) 5 sec | 1 min | 10 min | Fixability | Image density | Image density residual ratio (%) | Cleanability |
|---|---|---|---|---|---|---|---|---|
| Ex. 1 | (1) | 25.7 | 28.5 | 28.1 | Good | 1.68 | 95 | Good |
| Ex. 2 | (2) | 26.3 | 29.2 | 28.9 | Good | 1.69 | 93 | Good |
| Ex. 3 | (3) | 24.1 | 29.0 | 30.2 | Good | 1.68 | 94 | Good |
| Comp. Ex. 1 | (4) | 24.6 | 28.1 | 28.6 | Good | 1.39 | 80 | Poor |
| Comp. Ex. 2 | (5) | 25.2 | 27.5 | 26.7 | Good | 1.40 | 78 | Poor |

This document claims priority and contains subject matter related to Japanese Patent Applications Nos. 2005-255834 and 2006-003146, filed on Sep. 5, 2005, and Jan. 11, 2006, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin, comprising at least one polyester resin in an amount of from 50 to 100% by weight; and a colorant, having the following formula (I):

(I)

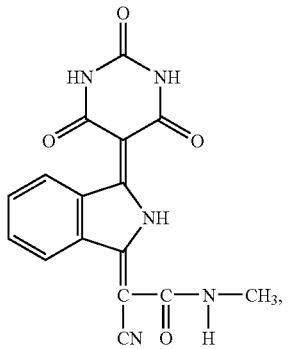

wherein the toner has a shape factor SF-1 of from 120 to 150 and a shape factor SF-2 of from 125 to 180;

wherein the toner is manufactured by a method using an aqueous medium;

wherein the method using an aqueous medium is a dissolution suspension method;

wherein the dissolution suspension method comprises:

dissolving or dispersing at least a polymer capable of reacting with an active hydrogen, which is a precursor of the binder resin, and the colorant, in an organic solvent to prepare a toner constituent mixture liquid, dispersing the toner constituent mixture liquid in an aqueous medium while subjecting the polymer to a reaction with a compound having an active hydrogen, to prepare a dispersion including toner particles, and removing the organic solvent from the dispersion, followed by washing and drying; and wherein the binder resin comprises a modified polyester resin and an unmodified polyester resin, and the polymer capable of reacting with an active hydrogen is a precursor of the modified polyester resin, and wherein a weight ratio of the modified polyester resin to the unmodified polyester resin is from 5/95 to 75/25.

2. The toner according to claim 1, further comprising a rosin resin present on at least a surface of the colorant.

3. The toner according to claim 1, wherein the dissolution suspension method further comprises dispersing the toner constituent mixture liquid in an aqueous medium containing a particulate resin while subjecting the polymer to a reaction with a compound having an active hydrogen, to prepare a dispersion including toner particles, on a surface of which the particulate resin is present.

4. The toner according to claim 3, wherein the particulate resin has a volume average particle diameter of from 5 to 500 nm.

5. The toner according to claim 1, wherein a weight ratio of the colorant to the organic solvent is from 5/95 to 50/50.

6. The toner according to claim 1, further comprising a release agent.

7. The toner according to claim 6, wherein the release agent has a melting point of from 40 to 160° C.

8. The toner according to claim 1, wherein the toner has a volume average particle diameter (Dv) of from 3.0 to 8.0 μm, and a ratio (Dv/Dn) between the volume average particle diameter (Dv) and a number average particle diameter (Dn) of from 1.00 to 1.30.

9. A developer, comprising the toner according to claim 1, and a carrier.

10. A toner comprising:

a binder resin, comprising at least one polyester resin in an amount of from 50 to 100% by weight; and a colorant, having the following formula (I):

(I)

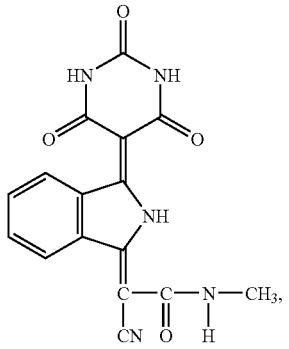

wherein the toner has a shape factor SF-1 of from 120 to 150 and a shape factor SF-2 of from 125 to 180;

wherein the toner is manufactured by a method using an aqueous medium;

wherein the method using an aqueous medium is a dissolution suspension method;

wherein the dissolution suspension method comprises:

dissolving or dispersing at least a polymer capable of reacting with an active hydrogen, which is a precursor of the binder resin, and the colorant, in an organic solvent to prepare a toner constituent mixture liquid, dispersing the toner constituent mixture liquid in an aqueous medium while subjecting the polymer to a reaction with a compound having an active hydrogen, to prepare a dispersion including toner particles, and removing the organic solvent from the dispersion, followed by washing and drying;

wherein the binder resin comprises a modified polyester resin and an unmodified polyester resin, and the polymer capable of reacting with an active hydrogen is a precursor of the modified polyester resin, and wherein a weight ratio of the modified polyester resin to the unmodified polyester resin is from 5/95 to 75/25; and wherein the modified polyester resin and the unmodified polyester resin, independently, have an acid value of from 0 to 30 mgKOH/g.

11. The toner according to claim 10, further comprising a rosin resin present on at least a surface of the colorant.

12. The toner according to claim 10, wherein the dissolution suspension method further comprises dispersing the toner constituent mixture liquid in an aqueous medium containing a particulate resin while subjecting the polymer to a reaction with a compound having an active hydrogen, to prepare a dispersion including toner particles, on a surface of which the particulate resin is present.

13. The toner according to claim 12, wherein the particulate resin has a volume average particle diameter of from 5 to 500 nm.

14. The toner according to claim 10, wherein a weight ratio of the colorant to the organic solvent is from 5/95 to 50/50.

15. The toner according to claim 10, further comprising a release agent.

16. The toner according to claim 15, wherein the release agent has a melting point of from 40 to 160° C.

17. The toner according to claim 10, wherein the toner has a volume average particle diameter (Dv) of from 3.0 to 8.0 μm, and a ratio (Dv/Dn) between the volume average particle diameter (Dv) and a number average particle diameter (Dn) of from 1.00 to 1.30.

18. A developer, comprising the toner according to claim 10 and a carrier.

* * * * *